US010638804B2

(12) United States Patent
Kua et al.

(10) Patent No.: US 10,638,804 B2
(45) Date of Patent: May 5, 2020

(54) ELASTOMERIC ARTICLE MANUFACTURING SYSTEM AND PROCESS

(71) Applicant: ALLEGIANCE CORPORATION, Waukegan, IL (US)

(72) Inventors: Hooi Guan Kua, Victoria (AU); Hean Huat Koed, Pulau Pinang (MY); Swee Hua Lim, Penang (MY)

(73) Assignee: ALLEGIANCE CORPORATION, Waukegan, IL (US)

( * ) Notice: Subject to any disclaimer, the term of this patent is extended or adjusted under 35 U.S.C. 154(b) by 0 days.

(21) Appl. No.: 16/141,346

(22) Filed: Sep. 25, 2018

(65) Prior Publication Data

US 2020/0093205 A1 Mar. 26, 2020

(51) Int. Cl.
*A41D 19/04* (2006.01)
*A41D 19/00* (2006.01)

(52) U.S. Cl.
CPC ..... *A41D 19/043* (2013.01); *A41D 19/0055* (2013.01)

(58) Field of Classification Search
CPC . A41D 19/043; A41D 19/055; B29C 37/0017
See application file for complete search history.

(56) References Cited

U.S. PATENT DOCUMENTS 2,510,341 A * 6/1950 Keller ..... A41D 19/043 223/40
2,838,216 A * 6/1958 Beasley ..... A41D 19/04 223/57
3,010,623 A * 11/1961 Parrish ..... A41D 19/04 223/78
3,010,624 A * 11/1961 Parrish ..... A41D 19/04 223/78
3,656,669 A * 4/1972 Conklin ..... A41D 19/043 223/40
3,738,547 A * 6/1973 Horton ..... A41D 19/043 223/40
3,820,383 A * 6/1974 Van Deventer ..... G07C 3/14 73/41
4,023,720 A * 5/1977 Filko ..... A41D 19/043 223/40
4,036,415 A * 7/1977 Filko ..... A41D 19/043 223/40
4,436,231 A * 3/1984 Kelly ..... A41D 19/043 223/40

(Continued)

*Primary Examiner* — David H Banh
(74) *Attorney, Agent, or Firm* — Arent Fox, LLP

(57) ABSTRACT

An elastomeric article processing system includes a conveyor chain driven by a prime mover, and a mounting mandrel configured to receive and support an elastomeric article. The mounting mandrel coupled to the conveyor chain. The mounting mandrel including an arm configured to support the elastomeric article, a movable engagement member that engages a portion of the elastomeric article to expose a printing area of the elastomeric article, and an anvil that engages the elastomeric article to support the printing area. The elastomeric article processing system also includes a printer configured to apply a marking to the printing area, and a glove inversion device configured to invert the elastomeric article while the elastomeric article is supported on the mounting mandrel.

15 Claims, 21 Drawing Sheets

(56) References Cited

U.S. PATENT DOCUMENTS

| | | | | |
|---|---|---|---|---|
| 5,776,520 | A * | 7/1998 | Howe | B29C 33/36 425/274 |
| 8,960,493 | B1 * | 2/2015 | Dennison | A47G 25/904 221/45 |
| 2004/0107477 | A1 * | 6/2004 | Janssen | A61L 31/10 2/161.7 |
| 2006/0115653 | A1 * | 6/2006 | Soerens | A61L 15/225 428/423.1 |
| 2016/0374416 | A1 * | 12/2016 | Wong | A41D 19/043 223/78 |

* cited by examiner

ELASTOMERIC ARTICLE MANUFACTURING SYSTEM AND PROCESS

FIELD OF THE INVENTION

The systems and methods of the present disclosure relate to manufacturing processes and systems, and more particularly to manufacturing processes and systems for elastomeric articles.

BACKGROUND

At present, the manufacture of certain elastomeric and polymer latex articles (such as surgical or examination gloves used in hospitals and other medical facilities, work gloves, prophylactics, catheters, balloons, etc.) typically involves two major processes, namely the on-line dipping or forming platform process (also known as the primary manufacturing process) and off-line processing (also known as the secondary manufacturing process), that occur prior to final processing and packaging.

In the primary manufacturing process, the elastomeric articles are formed using molds that are subjected to, for example, cleaning, dipping, and curing processes. After these processes are complete, the elastomeric articles are stripped (i.e., removed) from the mold by a human operator manually stripping the elastomeric articles (with or without the aid of machines) or, in certain cases, using an automated stripping machine. After the elastomeric articles are stripped from the molds, the elastomeric articles may be subjected to one or more off-line surface treatment processes (i.e., secondary processing). For example, the elastomeric articles may be subjected to an off-line chlorination process, which may involve chlorination, lubrication, and tumble drying. Additional processing may include quality and integrity testing, and ink marking to indicate, for example, a lot number, date, etc. In some cases, the elastomeric articles may be inverted and/or flattened to facilitate packaging, and in some cases the elastomeric articles may be cuffed prior to packaging. For example, a surgical glove may be manipulated such that all or a portion of the wrist and/or palm portions of the glove are inverted and folded over the palm or both the palm and finger portions of the glove to facilitate sterile donning of the glove. The completed elastomeric articles are then packaged for distribution.

SUMMARY OF THE INVENTION

The present invention provides, in one aspect, an elastomeric article processing system including a conveyor chain or belt driven by a prime mover, and a mounting mandrel configured to receive and support an elastomeric article. The mounting mandrel is coupled to the conveyor chain. The mounting mandrel includes one or more arms configured to support the elastomeric article, a first movable engagement member that engages and manipulates a portion of the elastomeric article to expose a printing area of the elastomeric article, and an anvil that engages the elastomeric article to support the printing surface. The system may include a printer configured to apply a marking to the printing surface, an inversion device and/or a cuffing device configured to invert or cuff at least a portion of the elastomeric article while the elastomeric article is supported on the mounting mandrel. The system may also include a second movable engagement member that engages and manipulates a portion of the elastomeric article to enlarge an aperture of the elastomeric article during the inverting process and/or the cuffing process. The system may also include a device configured to apply forced air or other gas or liquid to the elastomeric article to cause all or a portion of the elastomeric article to invert and pass through the aperture of the elastomeric article while the elastomeric article is supported on the mounting mandrel during the inverting process and/or the cuffing process. The system may also be configured to position the elastomeric article to be receivable by a packaging apparatus.

In another aspect, the present disclosure provides a method for manufacturing an elastomeric article using a mounting mandrel having an arm and a first movable engagement member. The method may include mounting the elastomeric article in an inverted position on the mounting mandrel. The method may also include operating the first movable engagement member to displace a portion of the elastomeric article to expose a printing surface. The method may further include engaging the elastomeric article with an anvil to support the printing surface. The method may also include printing, via a printer, a marking on the printing surface while the printing surface is exposed by the engaging member. The method may also include inverting and/or cuffing the elastomeric article after the printing, while the elastomeric article is supported on the mounting mandrel. The method may also include operating a second movable engagement member to displace a portion of the elastomeric article to enlarge an aperture of the elastomeric article while the elastomeric article is supported on the mounting mandrel during the inverting process and/or the cuffing process. The method may also include causing application of forced air or other gas or liquid to the elastomeric article to cause all or a portion of the elastomeric article to invert by passing through the aperture of the elastomeric article while the elastomeric article is supported on the mounting mandrel during the inverting process and/or the cuffing process. The method may also include positioning the elastomeric article to be receivable by a packaging apparatus.

The present invention provides, in another aspect, a mounting mandrel for supporting an elastomeric article on a conveyor chain of an elastomeric article processing system. The mounting mandrel may include a post configured to be coupled to the conveyor chain, a frame coupled to post, and may include an anvil assembly coupled to the post. The frame includes a first arm configured to engage and manipulate a first portion of the elastomeric article, a second arm, spaced from the first arm, configured to engage a second portion of the elastomeric article, and a first engagement member configured to effect displacement of a third portion of the elastomeric article. The anvil assembly may include an anvil configured to engage and manipulate a fourth portion of the elastomeric article. The frame may also include a second engagement member configured to engage and manipulate a fifth portion of the glove to enlarge a hand receiving aperture of the glove during the cuffing process. The mounting mandrel may also be configured to position the elastomeric article to be receivable by a packaging apparatus.

Other features and aspects of the invention will become apparent by consideration of the following detailed description and accompanying drawings.

Figure 1:
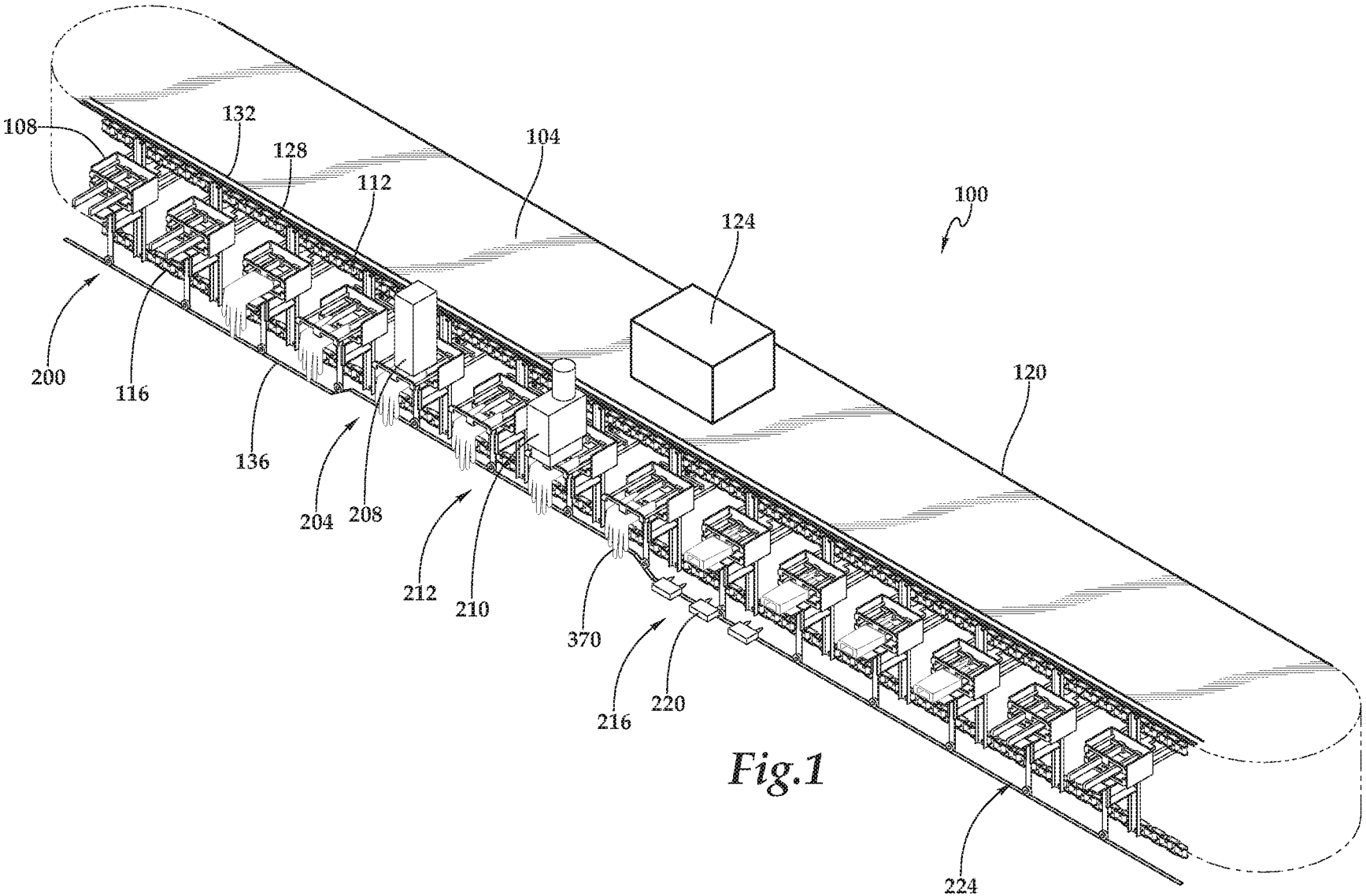
FIG. 1 is a perspective view illustration of one embodiment of an elastomeric article processing system in accordance with the present disclosure.
Figure 2:
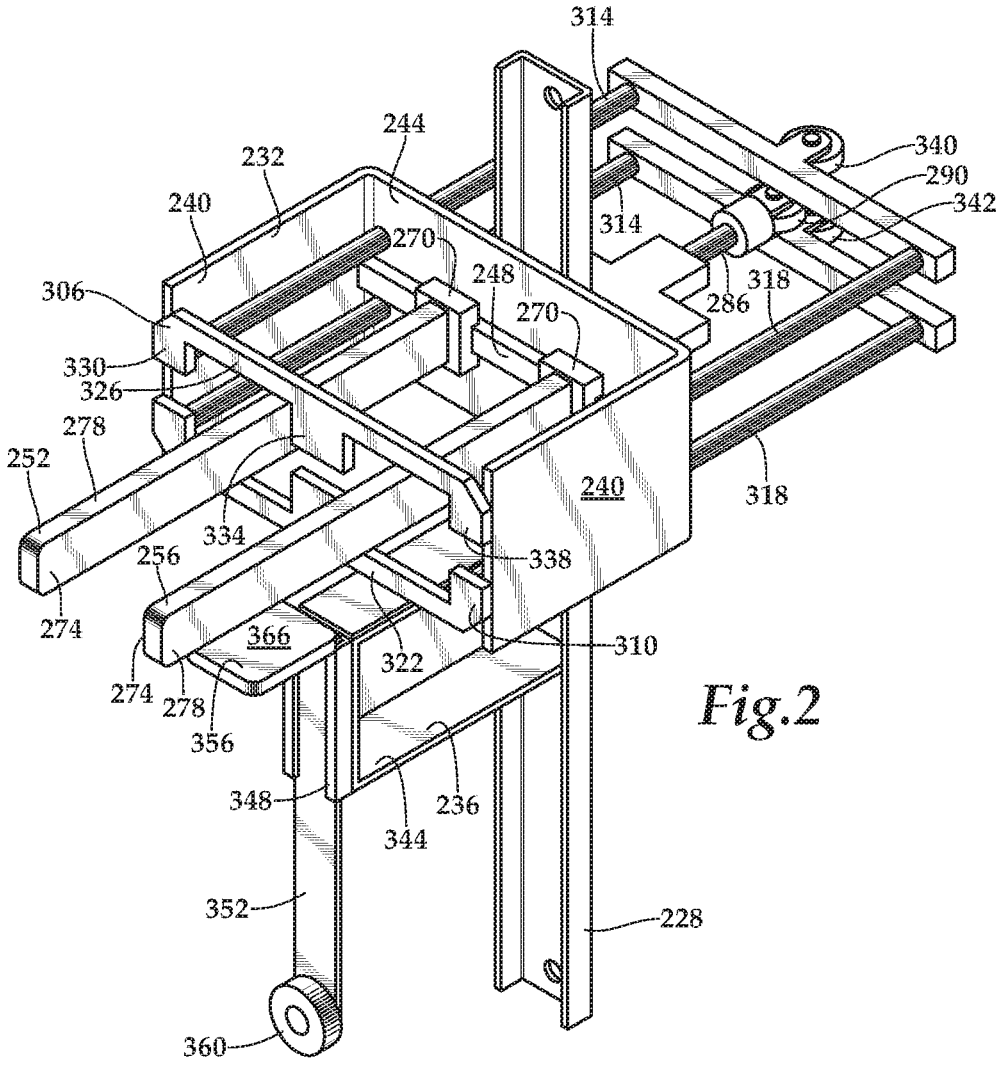
FIG. 2 is a perspective view illustration of a mounting mandrel of the elastomeric article processing system.
Figures 3, 4, 5:
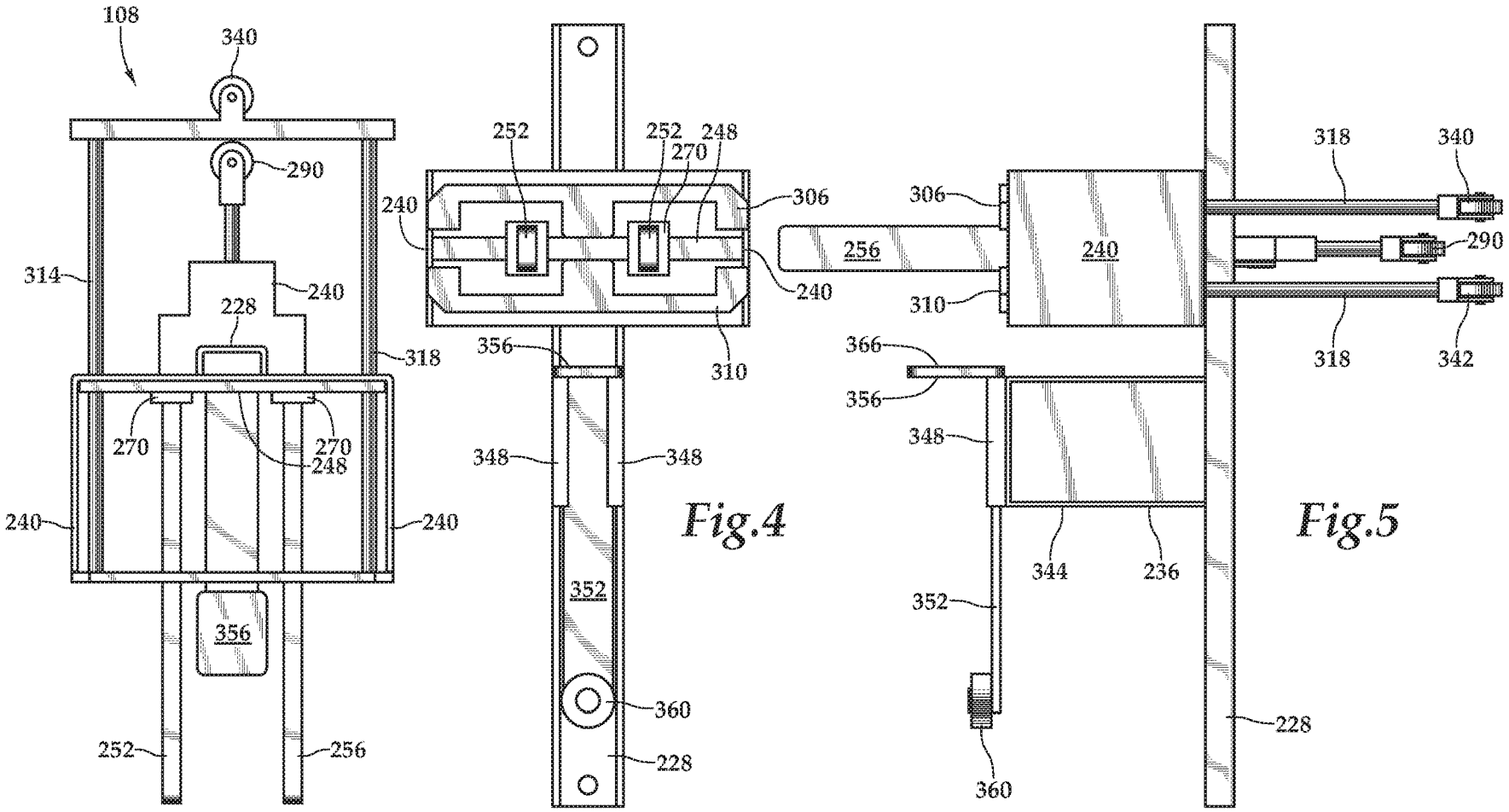
FIG. 3 is a top view illustration of the mounting mandrel of FIG. 2.
FIG. 4 is a front view illustration of the mounting mandrel of FIG. 2.
FIG. 5 is a side view illustration of the mounting mandrel of FIG. 2.
Figure 6:
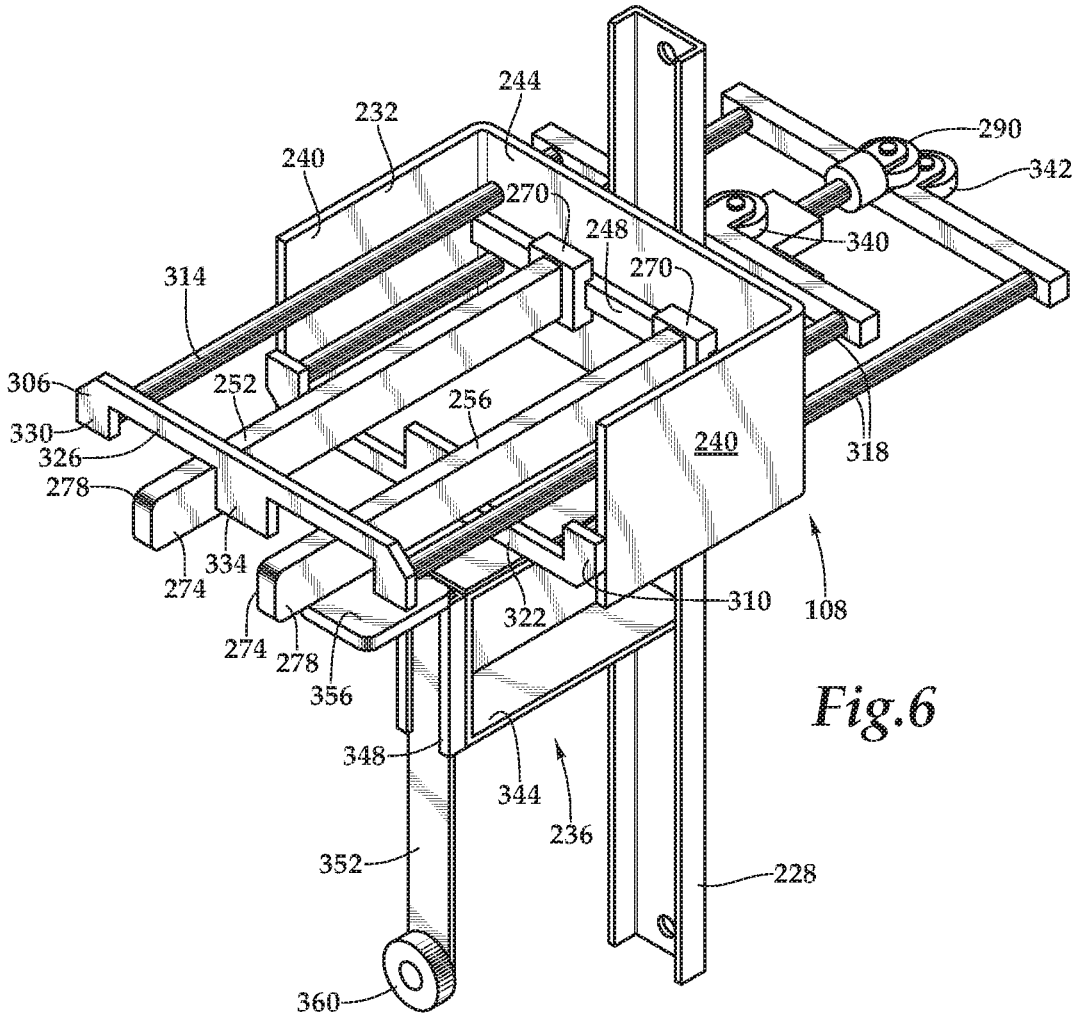
FIG. 6 is a perspective view illustration of the mounting mandrel of the elastomeric article processing system while in an uncovering configuration.
Figure 7:
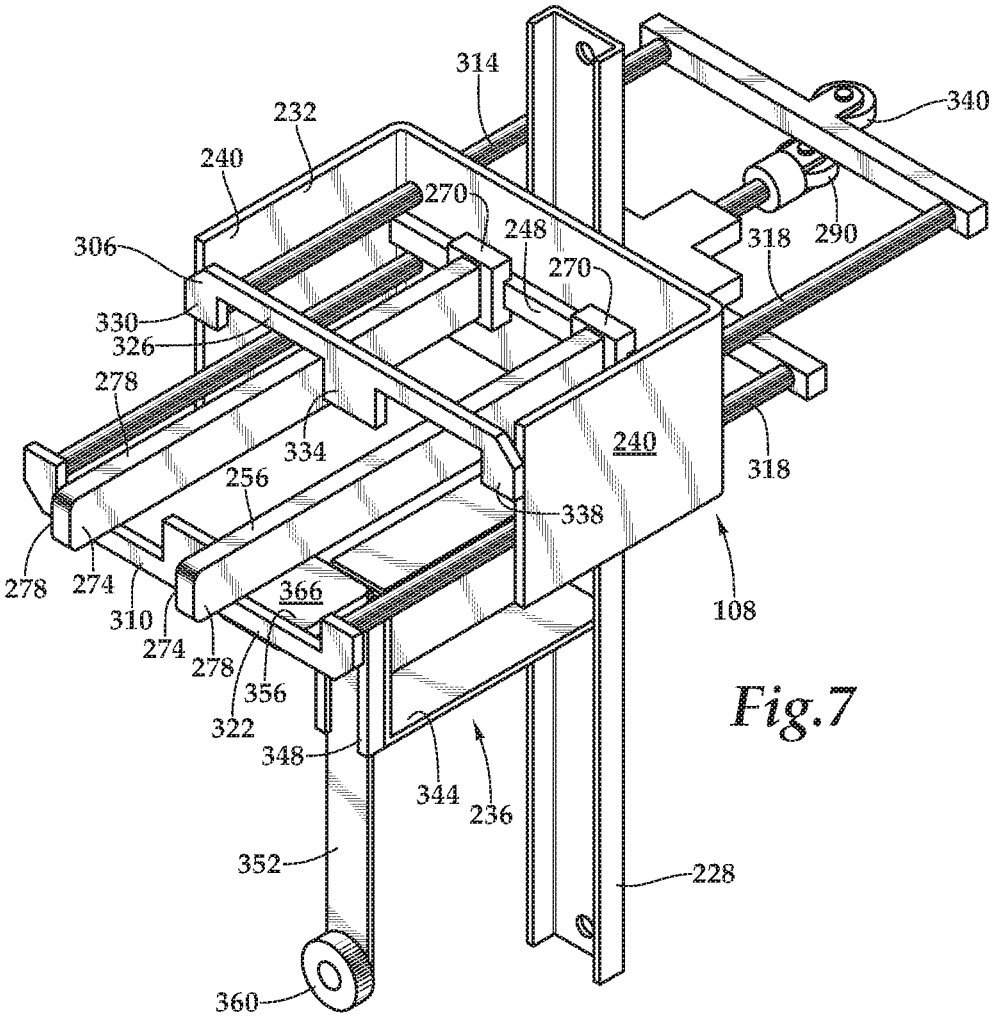
FIG. 7 is a perspective view illustration of the mounting mandrel of the elastomeric article processing system while in another uncovering configuration.
Figure 8:
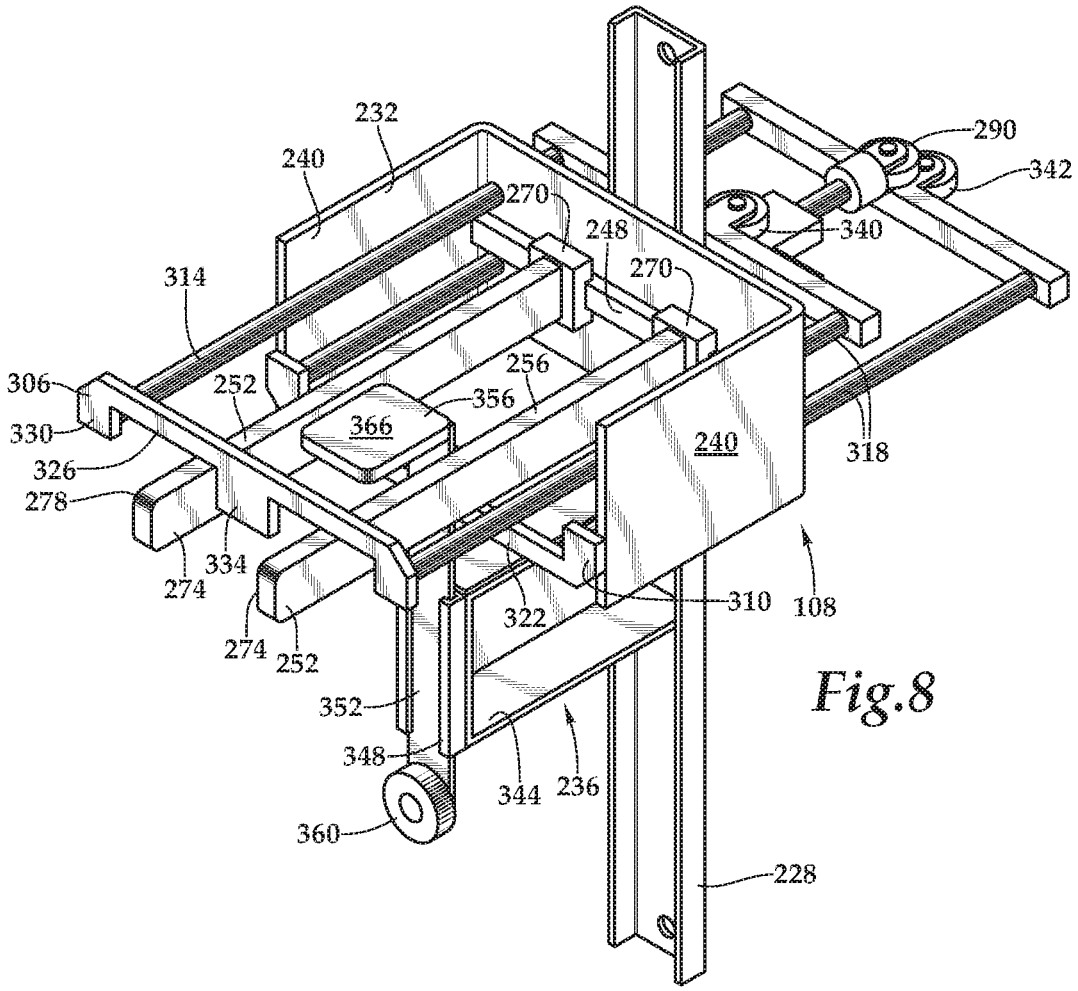
FIG. 8 is a perspective view illustration of the mounting mandrel of the elastomeric article processing system while in a printing configuration.

It should be understood that the figures are diagrammatic and schematic representations of exemplary embodiments of the systems and methods of the present disclosure, and are neither limiting nor necessarily drawn to scale.

DETAILED DESCRIPTION

The detailed description set forth below, in connection with the appended drawings, is intended as a description of various configurations and is not intended to represent the only configurations in which the concepts described herein may be practiced. The detailed description includes specific details for the purpose of providing a thorough understanding of the various concepts. However, it will be apparent to those skilled in the art that these concepts may be practiced without these specific details.

Various aspects of the systems and devices disclosed herein may be illustrated by describing components that are connected, coupled, attached, bonded and/or joined together. As used herein, the terms "connected", "coupled", "attached", "bonded" and/or "joined" are used interchangeably to indicate either a direct connection between two components or, where appropriate, an indirect connection to one another through intervening or intermediate components. Additionally, unless otherwise specified, these terms are used interchangeably to indicate a connection in which one or more degrees of freedom are not rigidly constrained between two components (e.g., a pivoting connection, a translating connection, a pivoting and translating connection, an elastic connection, a flexible connection, etc.), or a rigid or substantially rigid connection in which all degrees of freedom are constrained or substantially constrained between the two components.

Relative terms such as "lower" or "bottom", "upper" or "top", and "vertical" or "horizontal" may be used herein to describe one element's relationship to another element illustrated in the drawings. It will be understood that relative terms are intended to encompass different orientations of the systems and devices in addition to the orientation depicted in the drawings. By way of example, if aspects of a connector as illustrated in the drawings are turned over, elements described as being on the "bottom" side of the other element would then be oriented on the "top" side of the other elements as illustrated in the relevant drawing. The term "bottom" can therefore encompass both an orientation of "bottom" and "top" depending on the particular orientation of the drawing. Reference will now be made to figures wherein like structures are provided with like reference designations.

One embodiment of an elastomeric article processing system in accordance with the present disclosure is illustrated in FIG. 1. The elastomeric article processing system 100 is configured to accomplish a portion of the manufacturing process for an elastomeric article (e.g., an elastomeric glove, condom, balloon catheter, etc.). The elastomeric article processing system 100 includes a conveyor device 104 having a plurality of mounting mandrels 108 that receive, support, and manipulate an elastomeric article. As will be described in greater detail below, one example of the elastomeric article processing system 100 provides a processing system for a glove 370 in which the glove 370 is marked, inverted, and cuffed.

With reference to FIG. 1, the elastomeric article processing system 100 includes a conveyor device 104 having a pair of spaced apart conveyor chains 112, 116 (e.g., looped conveyor chains). In the illustrated embodiment, the conveyor chains 112, 116 are upper and lower conveyor chains. The conveyor chains 112, 116 are driven along a conveyor body 120 on, for example, roller bearings that run along a channeled bearing surface extending along a path of the conveyor chains 112, 116. At least one prime mover or drive unit 124, such as an electric motor, is operatively coupled to the conveyor chains 112, 116 via a transmission to control the movement of the conveyor chains 112, 116. The plurality of mounting mandrels 108, which receive, support, and manipulate the glove 370, are coupled to the conveyor chains 112, 116 at regular intervals for movement therewith.

With continued reference to FIG. 1, the conveyor device 104 also includes an arm actuating cam surface 128, first and second engagement member actuating cam surfaces 132, 134, and an anvil actuating cam surface 136 that are fixedly coupled to the conveyor body 120 at discrete locations about the outer surface. Each of the arm actuating cam surface 128, the engagement member actuating cam surfaces 132, 134, and the anvil actuating cam surface 136 operatively engage parts of each of the plurality of mandrels 108.

The arm actuating cam surface 128 extends about at least a portion of the conveyor body 120 in a direction generally parallel to, but spaced from, each of the conveyor chains 112, 116. The arm actuating cam surface 128 is sized and shaped to engage and support a cam follower, such as a roller bearing. As illustrated in FIGS. 12-23, the arm actuating cam surface 128 is a generally smooth surface, and includes a first linear portion 140, a first sloped portion 144, a second linear portion 148, a second sloped portion 152, and a third linear portion 156. The first linear portion 140 is disposed a first distance from the conveyor body 120, the second linear portion 148 is disposed at a second distance from the conveyor body 120 that is further than the first distance, and the third linear portion 156 is disposed at a third distance from the conveyor body 120 that is substantially equal to the first distance. The first sloped portion 144 smoothly interconnects the first linear portion 140 and the second linear portion 148, and the second sloped portion 152 interconnects the second linear portion 148 and the third linear portion 156 such that the arm actuating cam surface 128 is a continuous surface. The arm actuating cam surface 128 may extend completely about the conveyor body 120 such that the first linear portion 140 and third linear portion are continuous 156.

The first and second engagement member actuating cam surfaces 132, 134 each extend about at least a portion of the conveyor body 120 in a direction parallel to, but spaced from, each of the conveyor chains 112, 116 and the arm actuating cam surface 128. In the illustrated embodiment, the engagement member actuating cam surfaces 132, 134 are disposed between one of the conveyor chains 112, 116 (e.g., the upper conveyor chain 112) and the arm actuating cam surface 128, and in this embodiment, the first engagement member actuating cam surface 132 is located above the arm actuating cam surface 128, and the second engagement member actuating cam surface 134 is located below the arm actuating cam surface 128. The engagement member actuating cam surfaces 132, 134 are sized and shaped to engage and support a roller bearing, such as the illustrated roller bearings 340, 342. With continued reference to FIGS. 12-23, the illustrated first engagement member actuating cam surface 132 is a generally smooth surface, and includes a first linear portion 160, a first sloped portion 164, a second linear portion 168, a second sloped portion 172, and a third linear portion 176. The first linear portion 160 is disposed a first distance from the conveyor body 120, the second linear portion 168 is disposed at a second distance from the conveyor body 120 that is further than the first distance, and the third linear portion 176 is disposed at a third distance from the conveyor body 120 that is substantially equal to the first distance. The first sloped portion 164 smoothly interconnects the first linear portion 160 and the second linear portion 168, and the second sloped portion 172 interconnects the second linear portion 168 and the third linear portion 176 such that the first engagement member actuating cam surface 132 is a continuous surface. The illustrated second engagement member actuating cam surface 134 is a generally smooth surface, and includes a first linear portion 162, a first sloped portion 166, a second linear portion 170, a second sloped portion 174, and a third linear portion 178. The first linear portion 162 is disposed a first distance from the conveyor body 120, the second linear portion 170 is disposed at a second distance from the conveyor body 120 that is further than the first distance, and the third linear portion 178 is disposed at a third distance from the conveyor body 120 that is substantially equal to the first distance. The first sloped portion 166 smoothly interconnects the first linear portion 162 and the second linear portion 170, and the second sloped portion 174 interconnects the second linear portion 170 and the third linear portion 178 such that the second engagement member actuating cam surface 134 is a continuous surface. The first and second engagement member actuating cam surfaces 132, 134 may extend completely about the conveyor body 120 such that the first linear portions 160, 162 and third linear portions 176, 178 are continuous.

The anvil actuating cam surface 136 extends about at least a portion of the conveyor body 120 in a direction parallel to, but spaced from, each of the conveyor chains 112, 116, the arm actuating cam surface 128, and the engagement member actuating cam surfaces 132, 134. In the illustrated embodiment, the anvil actuating cam surface 136 is disposed between one of the conveyor chains 112, 116 (e.g., the lower conveyor chain 116) and the arm actuating cam surface 128. The anvil actuating cam surface 136 is a generally smooth surface that is sized and shaped to engage and support a roller bearing, with the cam surface of the anvil actuating cam surface 136 being disposed generally perpendicularly to the cam surfaces of the arm actuating cam surface 128 and the engagement member actuating cam surfaces 132, 134. With continued reference to FIGS. 12-23, the illustrated anvil actuating cam surface 136 includes a first linear portion 180, a first sloped portion 184, a second linear portion 188, a second sloped portion 192, and a third linear portion 196. The first linear portion 180 is disposed a first distance from a reference plane (e.g., the ground), the second linear portion 188 is disposed at a second distance from the reference plane that is further than the first distance, and the third linear portion 196 is disposed at a third distance from the reference plane that is substantially equal to the first distance. The first sloped portion 184 smoothly interconnects the first linear portion 180 and the second linear portion 188, and the second sloped portion 192 interconnects the second linear portion 188 and the third linear portion 196 such that the anvil actuating cam surface 136 is a continuous surface. The anvil actuating cam surfaces 132, 134 may extend completely about the conveyor body 120 such that the first linear portion 180 and third linear portion 196 are continuous.

Referring back to FIG. 1, the elastomeric article processing system 100 includes the mounting mandrels 108 that are coupled for movement with the conveyor chains 112, 116 through a plurality of manufacturing or processing stations. The processing stations include a mounting area 200, a marking area 204 having a printer 208 that applies a marking to the glove 370, an inspection area 212, an inversion or cuffing area 216 having a glove inversion device 220, and an unloading area 224. Each of the printer 208 and the glove inversion device 220 may be either directly supported on the conveyor device 104 or may be independent of the conveyor device 104.

Figure 12:
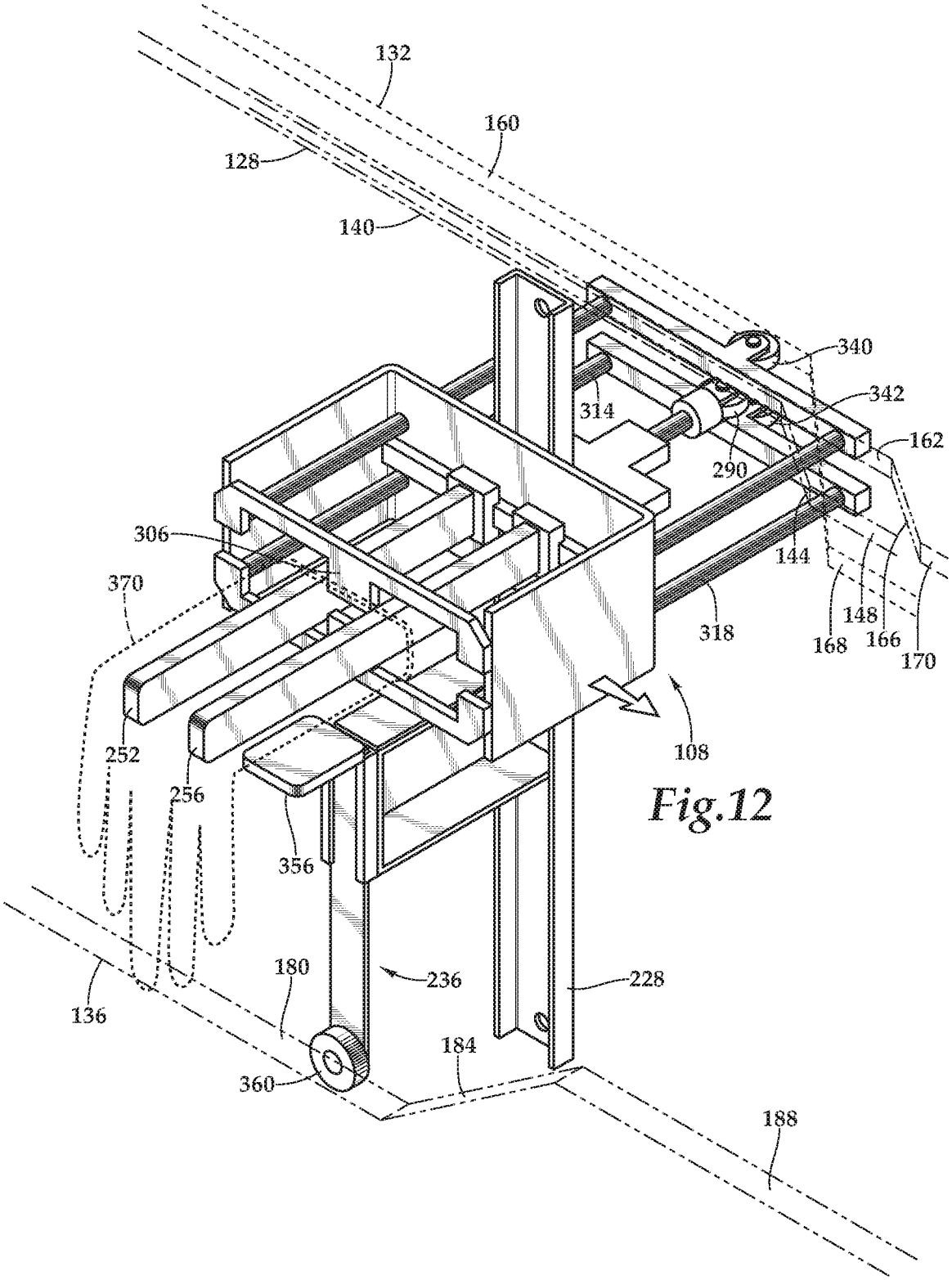
FIG. 12 is a perspective view illustration of the elastomeric article processing system with the mounting mandrel in a mounting area.

The mounting area 200 is generally defined along a section of the conveyor body 120 where at least part of the first linear portion 140 of the arm actuating cam surface 128, the first linear portion 180 of the anvil actuating cam surface 136, the first linear portion 160 of the first engagement member actuating cam surface 132, and the first linear portion 162 of the second engagement member actuating cam surface 134 overlap (see FIG. 12). The mounting area 200 is an area where the gloves 370 are mounted (e.g., either manually or via an automated device) on the mandrels 108.

Figure 18:
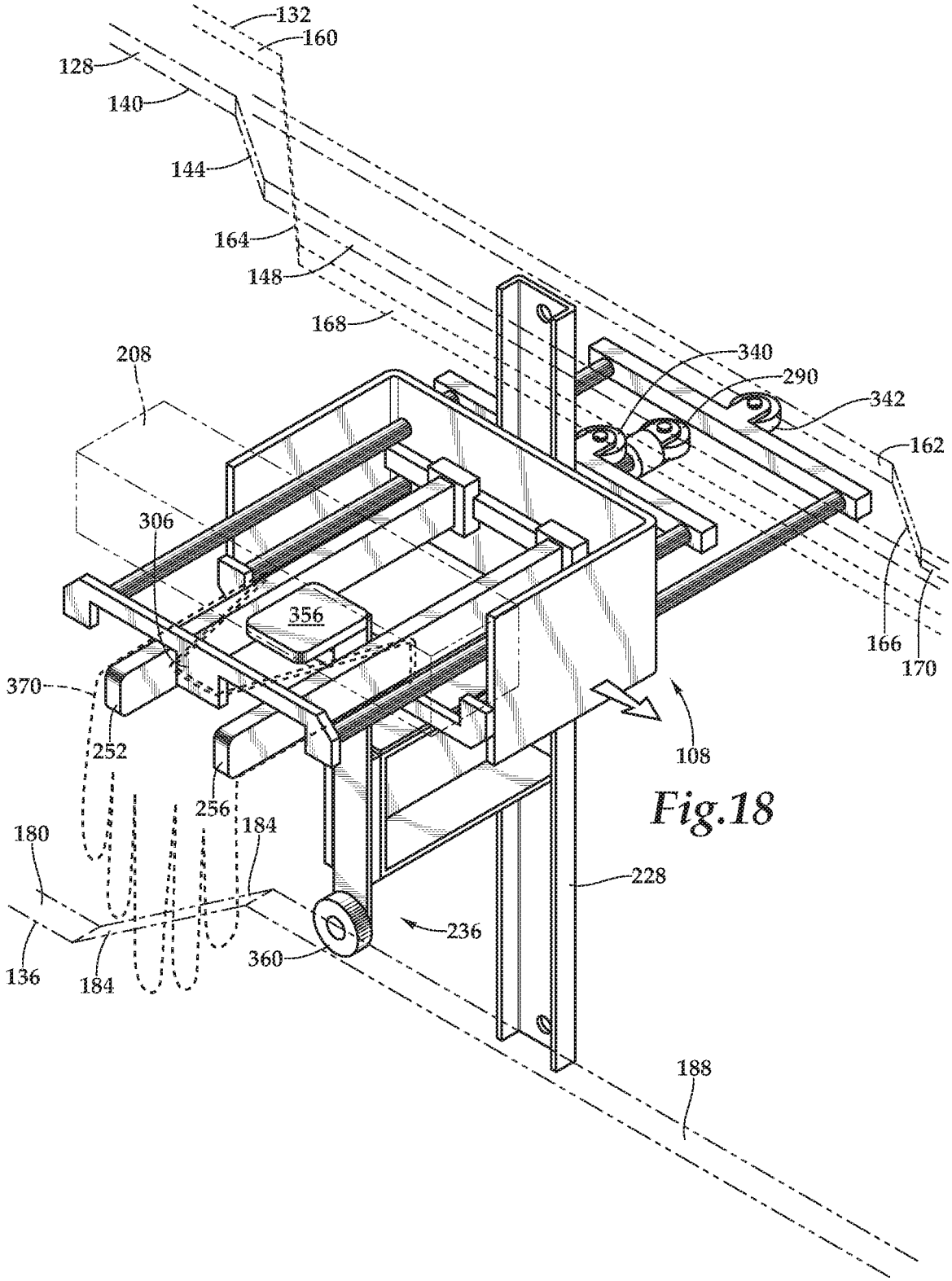
FIG. 18 is a perspective view illustration of the elastomeric article processing system with the mounting mandrel in a printing area.

The marking area 204 is downline from the mounting area 200, and is generally defined along a section of the conveyor body 120 where at least part of the second linear portion 148 of the arm actuating cam surface 128, the second linear portion 168 of the first engagement member actuating cam surface 132, the first linear portion 162 of the second engagement member actuating cam surface 134, and the second linear portion 188 of the anvil actuating cam surface 136 overlap (see FIG. 18). The marking area 204 is an area where the gloves 370 are marked with, for example, a size, a lot number, or another marking or set of markings by the printer 208.

Figure 19:
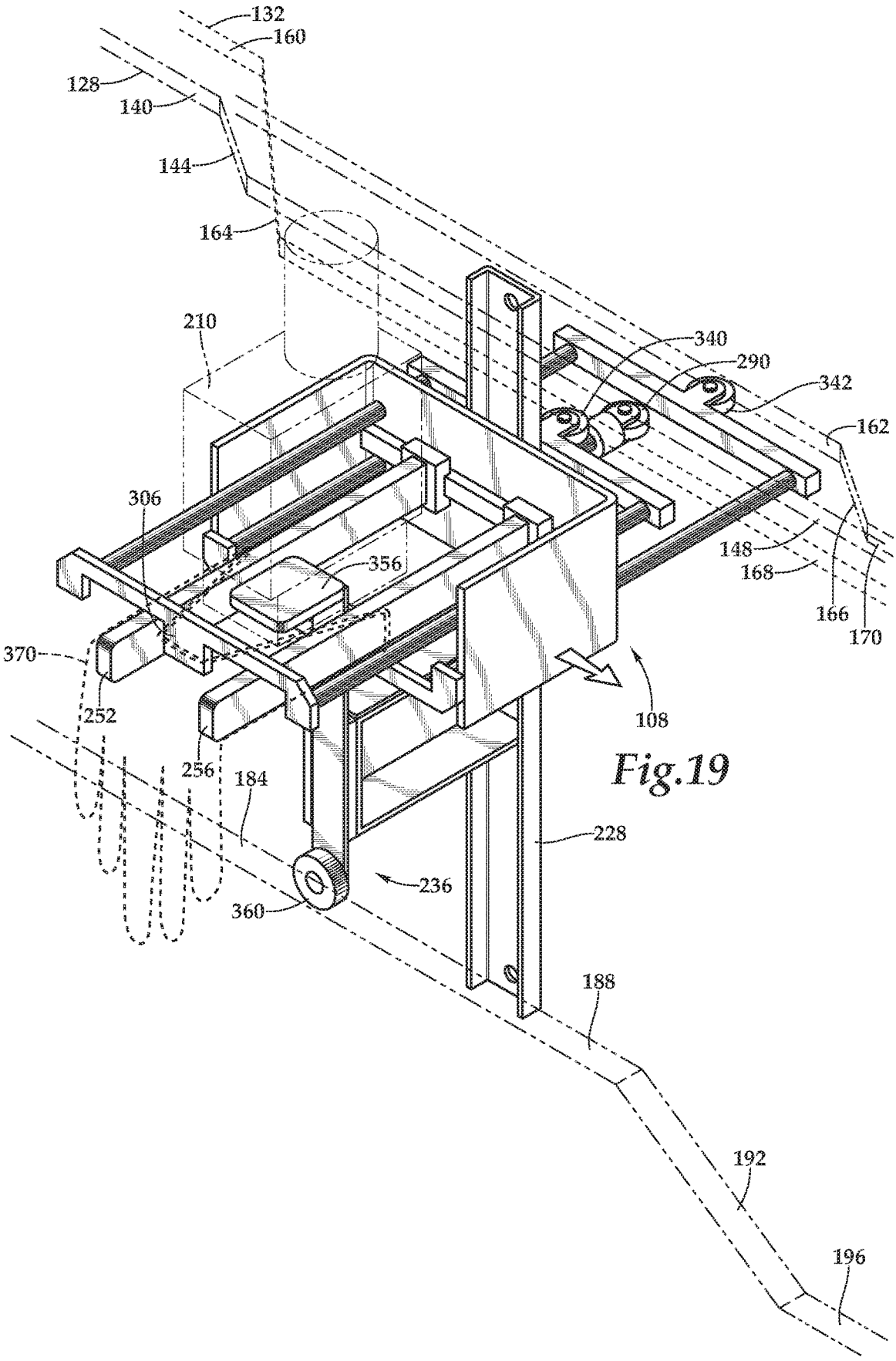
FIG. 19 is a perspective view illustration of the elastomeric article processing system with the mounting mandrel in an inspection area.

The inspection area 212 is downline from the marking area 204, and is generally defined along a section of the conveyor body 120 that includes at least another part of the second linear portion 148 of the arm actuating cam surface 128, the second linear portion 168 of the first engagement member actuating cam surface 132, the first linear portion 162 of the second engagement member actuating cam surface 134, and the second linear portion 188 of the anvil actuating cam surface 136 overlap (see FIG. 19). The inspection area 212 is where the markings made by the printer 208 may be inspected for quality and accuracy (e.g., manually or via an automated visual inspection or scanning device 210).

Figure 21:
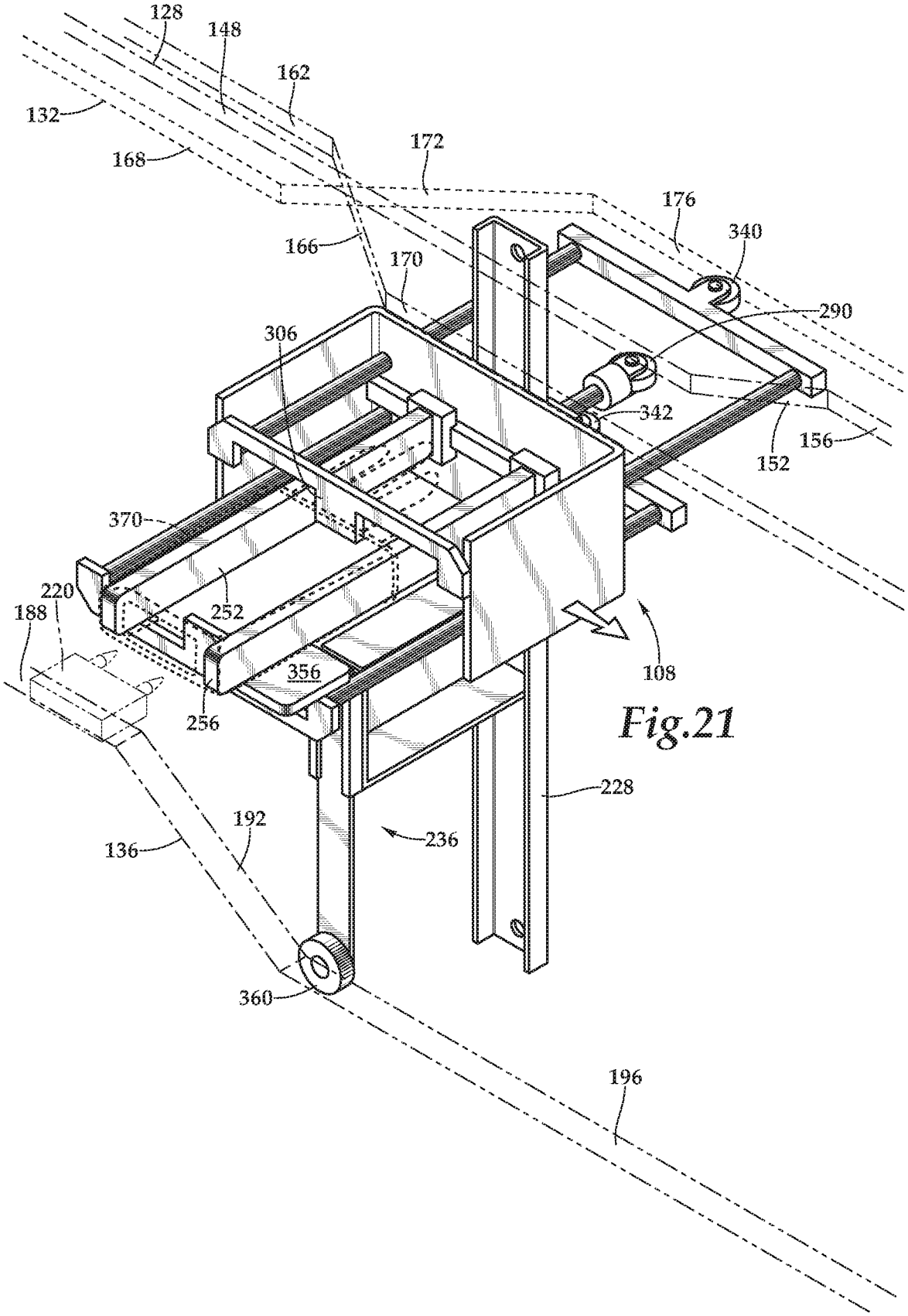
FIG. 21 is a perspective view illustration of the elastomeric article processing system with the mounting mandrel in an inversion area.

The inversion or cuffing area 216 is downline from the inspection area 212, and is generally defined along a section of the conveyor body 120 where the second linear portion 148 of the arm actuating cam surface 128, the third linear portion 176 of the first engagement member actuating cam surface 132, the second linear portion 162 of the second engagement member actuating cam surface 134, and the third linear portion 196 of the anvil actuating cam surface 136 overlap (see FIG. 21). The inversion area 216 is where gloves 370 may be at least partially inverted by the glove inversion device 220 while simultaneously forming a cuff on the glove.

Figure 23:
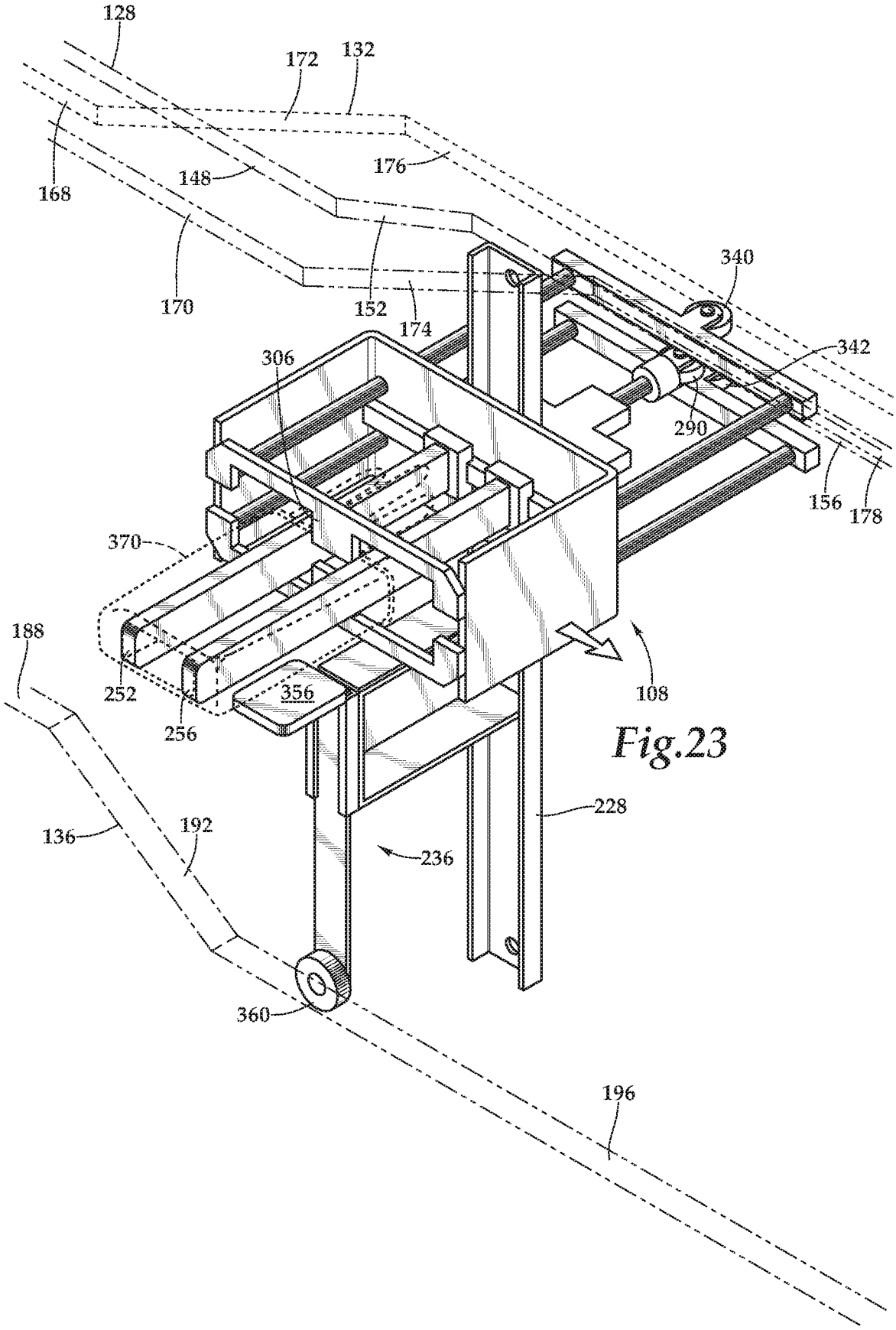
FIG. 23 is a perspective view illustration of the elastomeric article processing system with the mounting mandrel in an unloading area.

The unloading area 224 is downline from the inversion area 216, and is generally defined along a section of the conveyor body 120 where the third linear portion 156 of the arm actuating cam surface 128, the third linear portion 176 of the first engagement member actuating cam surface 132, the third linear portion 162 of the second engagement member actuating cam surface 134, and the third linear portion 196 of the anvil actuating cam surface 136 overlap (see FIG. 23). The unloading area 224 is where the gloves 370 may be removed or unloaded (e.g., manually or via an automated device) from the mandrels 108.

An exemplary embodiment of one of the mounting mandrels 108 is illustrated in FIGS. 2-8. Although only one of the mounting mandrels 108 is illustrated and described, it should be understood that each of the mounting mandrels connected to the system 100 may be similarly configured. The illustrated mounting mandrel 108 includes a post 228 that is coupled to the conveyor chains 112, 116. The post 228 supports a frame 232 and an anvil assembly 236. The frame 232 includes two parallel support members 240 extending away from a base member 244 to define a U-shape. A rail 248 extends along the base member 244 between the two parallel support members 240 and slidably supports a first arm 252 and a second arm 256. Each of the first arm 252 and the second arm 256 includes a first end having a bearing member 270 coupled to the rail 248 and a free second end. The free second ends each include an inner surface 274 in facing relation with one another and an outer surface or gripping surface 278 on an opposed side of each of the first arm 252 and the second arm 256 such that the outer surfaces 278 face laterally outward (i.e., towards one of the support members 240 of the frame 232). At least a portion of the arms 252, 256 engage the glove 370 to support the glove 370 on the mandrel 108.

Figure 9A:
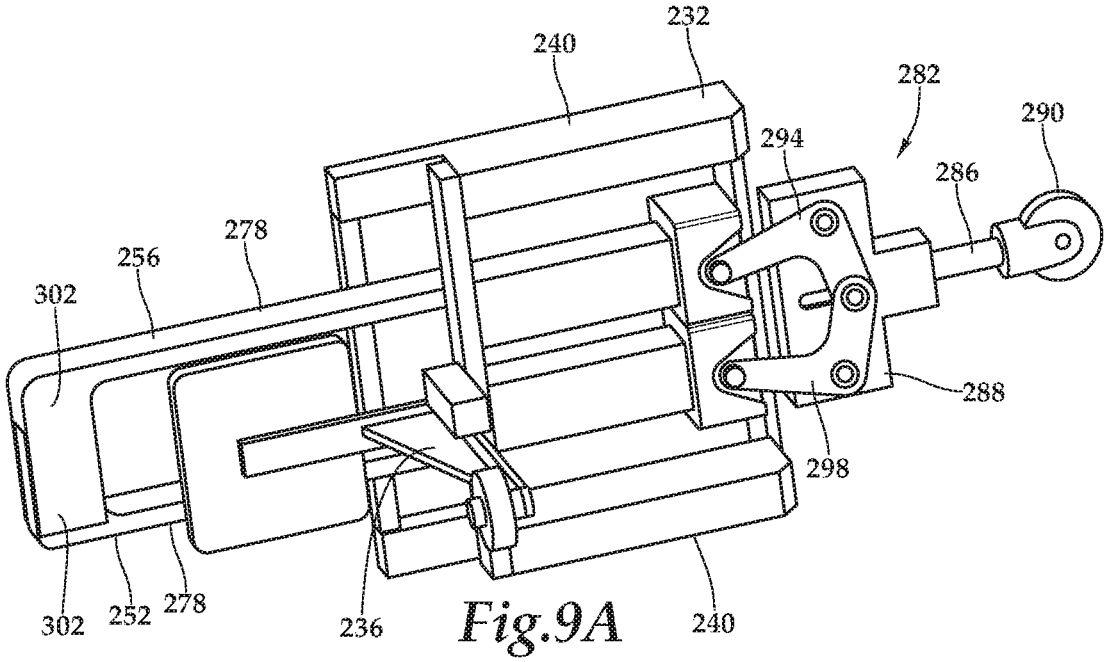
FIG. 9A is a bottom view illustration of a portion of the mounting mandrel in a disengaged position.
Figure 9B:
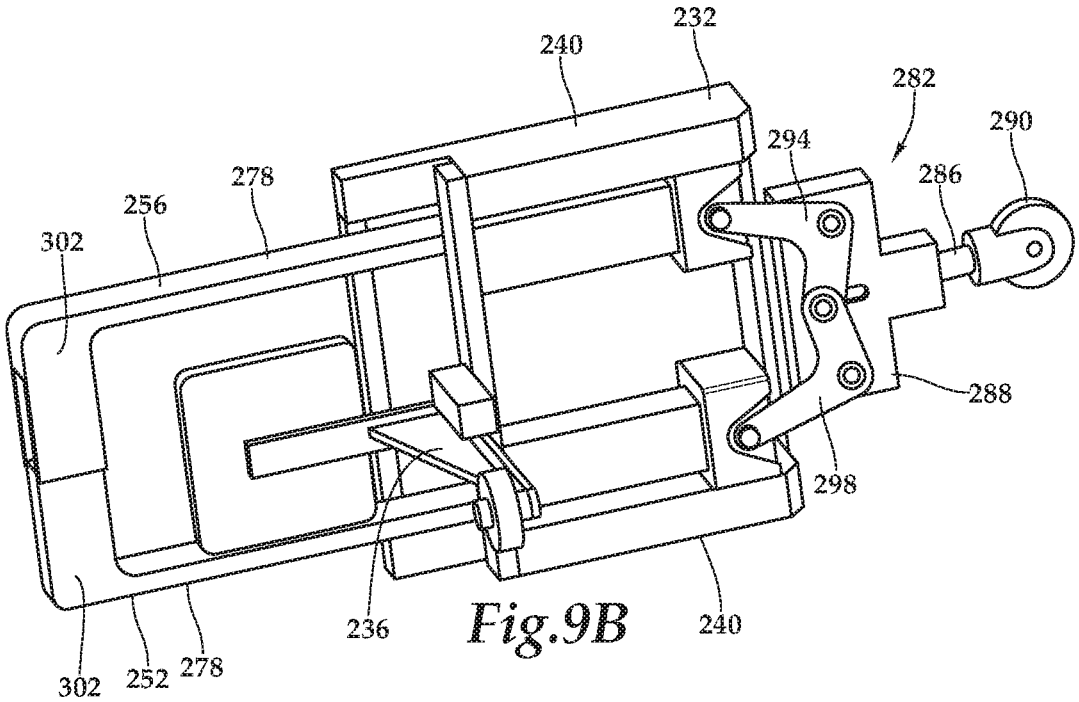
FIG. 9B is a bottom view illustration of a portion of the mounting mandrel in an engaged position.

Each of the first arm 252 and the second arm 256 may be coupled to an extension assembly such as the extension assembly 282 illustrated in FIGS. 9A and 9B. The extension assembly 282 includes a linearly movable input shaft 286 supported by a support member 288 that is coupled to the mounting mandrel 108. The input shaft 286 includes a roller bearing 290 on a first end and a pair of brackets 294, 298 coupled to a second end. The brackets 294, 298 are each pivotable about a pivot pin connection with the support member 288. A first end of each bracket 294, 298 is coupled to the input shaft 286, and a second end of each bracket 294, 298 is coupled to the first arm 252 and the second arm 256, respectively. As such, linear displacement of the input shaft 286 relative to the frame 232 causes the brackets 294, 298 to pivot, thereby resulting in linear displacement of the first arm 252 and the second arm 256 along the sliding rail 248 in a direction perpendicular to the movement of the input shaft 286 so the first arm 252 and the second arm 256 move away from each other. That is, linear displacement of the input shaft 286 causes the first arm 252 and the second arm 256 to move closer to one another into a disengaged position (FIG. 9A) when the roller bearing 290 engages the first linear portion 140 (see FIG. 12) or the third linear portion 156 (see FIG. 23) of the arm actuating cam surface 128. Conversely, the first arm 252 and the second arm 256 move away from one another into an engaged position (FIG. 9B) when the roller bearing 290 engages the second linear portion 148 of the arm actuating cam surface 128 (see FIG. 14).

It should be noted that FIGS. 9A and 9B illustrate an alternate embodiment of the second ends of the first arm 252 and the second arm 256 where the second ends include mating L-shaped brackets 302 to interconnect the movable first arm 252 and the second arm 256, while permitting movement of the arms 252, 256 relative to one another. Movement of the arms 252, 256 in the embodiment of the mounting mandrel 108 illustrated in FIGS. 2-8, however, is generally the same as movement of the arms 252, 256 described above with reference to FIGS. 9A and 9B.

In various alternative embodiments, only one of the arms is movable relative to the frame and the other one of the arms is stationary relative to the frame, so that movement of the movable arm relative to the frame achieves movement of the arms relative to each other. In various embodiments, the mounting mandrel includes more than two arms, any one or more of which are movable relative to the other arms. In various embodiments, the mounting mandrel includes an expandable arm such as, for example, an inflatable bladder configured to expand to engage the inner surface of the elastomeric article.

The roller bearing 290 of the input shaft 286 is operatively engaged with the arm actuating cam surface 128 such that movement of the roller bearing 290 along the arm actuating cam surface 128 effects linear displacement of the input shaft 286 between the disengaged position and the engaged position. In one embodiment, the input shaft 286 is biased (e.g., by a spring) toward the arm actuating cam surface 128 to maintain engagement between the roller bearing 290 and the arm actuating cam surface 128. In an alternate embodiment, the roller bearing 290 may be received within a track or channel defined on the arm actuating cam surface 128 to maintain engagement between the roller bearing 290 and the arm actuating cam surface 128. In another alternate embodiment, the input shaft 286 may be coupled to an actuator (e.g., a linear actuator, a solenoid, etc.) to effect movement of the input shaft 286.

With renewed reference to FIGS. 2-8, the frame 232 also supports a first engagement member 306 disposed on a first side (e.g., an upper side) of the first arm 252 and the second arm 256, and a second engagement member 310 disposed on a second side (e.g., a lower side) of the first arm 252 and the second arm 256. Each of the first engagement member 306 and the second engagement member 310 includes a pair of bars 314, 318 extending through apertures in the base member 244 of the frame 232 such that the bars 314, 318 are supported by the frame 232 and freely movable through the apertures. In various embodiments, linear bearings may be implemented to facilitate translation of the bars 314, 318 relative to the frame 232. An engagement element 322, 324 is coupled to a first end of each of the bars 314, 318 of both the first engagement member 306 and the second engagement member 310. Each engagement element 322, 324 is a substantially "E" shaped element defined by a linear portion 326 having three spaced extensions 330, 334, 338 depending therefrom in a direction that is perpendicular to the linear portion 326. The central extension 334 defines a primary glove engaging section. As seen in FIGS. 2-8, the engagement elements 322, 324 are in facing relation to one another such that the first arm 252 and the second arm 256 may extend through gaps defined between pairs of extensions. In various embodiments, the engagement elements could have any suitable shape or configuration that would allow the engagement elements to engage and manipulate a portion of the elastomeric article without interfering with the function of the other components of the mandrel 108. In various embodiments, the mandrel 108 may only include a single engagement member (i.e., one of the engagement members 306, 310 is omitted), and the single engagement member may be configured to engage and manipulate one or more portions of the glove 370 to either expose the printing area 400 of the glove 370 or enlarge the hand receiving aperture 382, or both.

Roller bearings 340, 342 are coupled to a second end of the bars 314, 318 of both the first engagement member 306 and the second engagement member 310. The roller bearings 340, 342 are operatively engaged with the engagement member actuating cam surfaces 132, 134 such that movement of the roller bearings 340, 342 along the engagement member actuating cam surfaces 132, 134 effects linear displacement of the engagement members 306, 310 between retracted positions (FIGS. 2-5), where the roller bearings 340, 342 are engaged with the first linear portions 160, 162 (see FIG. 12) or the third linear portions 176, 178 (see FIG. 23) of the engagement member actuating cam surfaces 132, 134, and extended positions (FIGS. 6-8), where the roller bearings 340, 342 are engaged with the second linear portions 168, 170 of the engagement member actuating cam surfaces 132, 134 (see FIGS. 15-16). In one embodiment, the engagement members 306, 310 are biased (e.g., by one or more springs) toward the engagement member actuating cam surfaces 132, 134 to maintain engagement between the roller bearings 340, 342 and the engagement member actuating cam surfaces 132, 134. In an alternate embodiment, one or more of the roller bearings 340, 342 may be received within a track or channel defined on the engagement member actuating cam surfaces 132, 134 to maintain engagement between the roller bearings 340, 342 and the engagement member actuating cam surfaces 132, 134. In another alternate embodiment, the bars 314, 318 or the engagement members 306, 310 may be coupled to one or more actuators (e.g., linear actuators, solenoids, etc.) to effect movement of the input shaft bars 314, 318 and/or the engagement members 306, 310.

With continued reference to FIGS. 2-8, the anvil assembly 236 includes a support structure 344 fixedly coupled to the post 228. The support structure includes an extruded rail 348 slidably supporting a rod 352 that has an anvil 356 fixed to a first end and a roller bearing 360 coupled to a second end. The anvil 356 includes a generally planar or smooth surface 366 that selectively engages the glove 370 to, for example, support a portion of the glove 370 during printing.

The roller bearing 360 is operatively engaged with the anvil actuating cam surface 136 such that movement of the roller bearing 360 along the anvil actuating cam surface 136 effects linear displacement of the anvil 356 between a disengaged position (FIGS. 2-7), where the roller bearing 360 engages the first linear portion 180 (see FIG. 12) or third linear portion 196 (see FIG. 23) of the anvil actuating cam surface 136, and an engaged position (FIG. 8), where the roller bearing 360 engages the second linear portion 188 of the anvil actuating cam surface 136 (see FIG. 18). In one embodiment, the anvil 356 is biased (e.g., by a spring) toward the anvil actuating cam surface 136 to maintain engagement between the roller bearing 360 and the anvil actuating cam surface 136. In an alternate embodiment, the roller bearing 360 may be received within a track or channel defined on the anvil actuating cam surface 136 to maintain engagement between the roller bearing 360 and the anvil actuating cam surface 136. In another alternate embodiment, the rod 352 may be coupled to an actuator (e.g., a linear actuator, a solenoid, etc.) to effect movement of the rod 352. In yet another embodiment, the weight of the rod 352 and anvil 356 may be sufficient to maintain engagement of the roller bearing 360 and the anvil actuating cam surface 136.

Figure 10C:
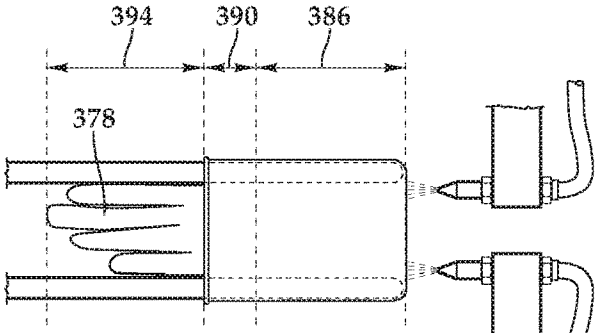
FIGS. 10A-C are perspective view illustrations of an elastomeric glove in various processing positions.
Figure 10B:
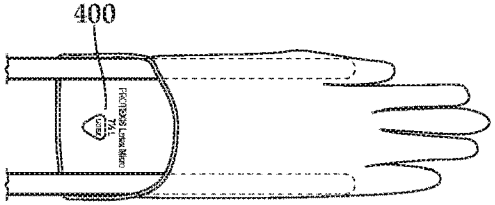
Figure 10A:
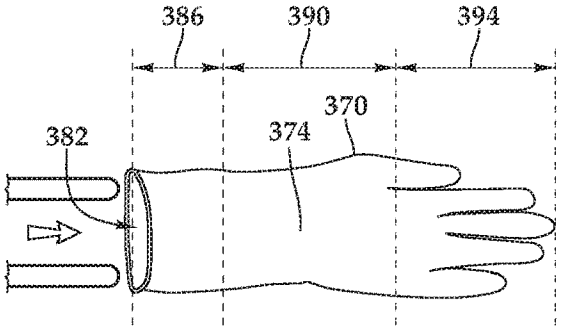

FIGS. 10A-C illustrate the glove 370 that is processed by the elastomeric article processing system 100 in greater detail. The glove 370 includes an interior side 374 (i.e., the donning side), an exterior side 378, and a hand receiving aperture 382. The glove 370 is also divided into a cuff or wrist portion 386, a palm portion 390, and a finger portion 394. A printing area 400 that receives a marking (e.g., a product marking, a brand marking, and/or a serial number, etc.) is defined on the wrist portion 386.

With continued reference to FIGS. 10A-C, the glove 370 is movable by the elastomeric article processing system 100 (e.g., by the mounting mandrel 108) between an inverted or loading position, in which the interior side 374 faces outward (FIG. 10A), and a standard or packing position (FIG. 10C), in which the exterior side 378 faces outward and the wrist portion 386 is folded towards the palm portion 390 and finger portions 394 thereby exposing a portion of the interior side 374 to create a cuff. Between the inverted loading position and the standard position, the glove 370 is manipulated to an intermediate or printing position (FIG. 10B). In the intermediate or printing position, the glove 370 is inverted, but a section of the wrist portion 386 is displaced (e.g., by the mounting mandrel 108) toward the palm and finger portions 390, 394 to expose the printing area 400 (which is 'inside' the glove 370 in this inverted orientation).

Figure 11:
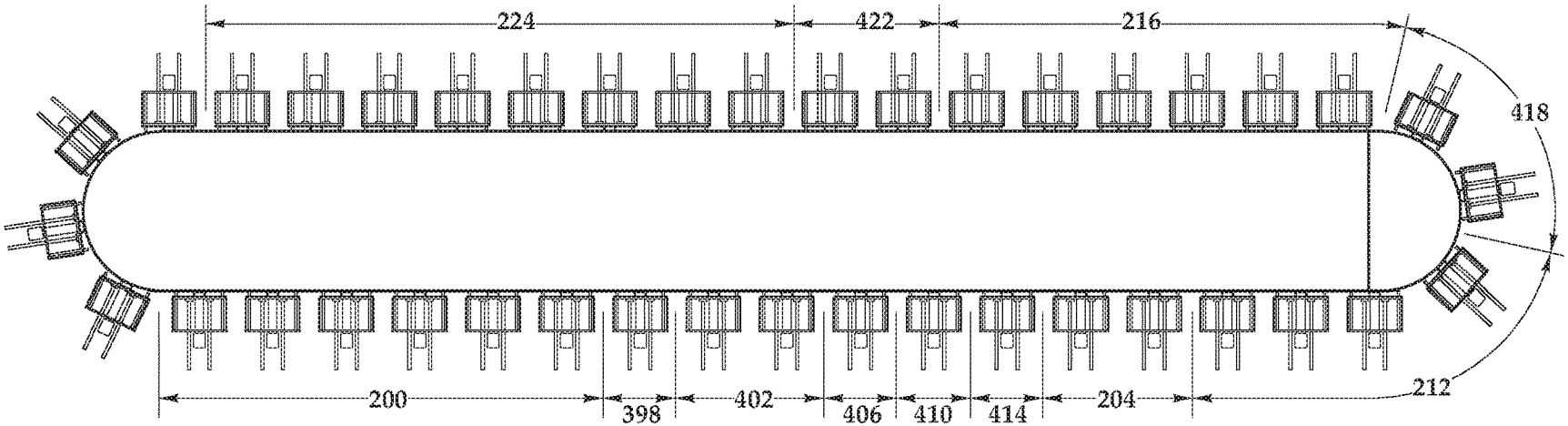
FIG. 11 is a top schematic view illustration of the elastomeric article processing system.

With reference to FIG. 11, the elastomeric article processing system 100 includes the mounting area 200, a first transition area 398, a gripping area 402, a second transition area 406, an uncovering area 410, a third transition area 414, the marking area 204, the inspection area 212, a fourth transition area 418, the inversion area 216, a fifth transition area 422, and the unloading area 224. Due to the continuous nature of the conveyor chains 112, 116 supporting the mandrels 108, multiple mandrels 108 can occupy each of the mounting area 200, the gripping area 402, the uncovering area 410, the marking area 204, the inspection area 212, the inversion area 216, and the unloading area 224 at any given time. However, the configuration of the mandrels 108 in each of the mounting area 200, the first transition area 398, the gripping area 402, the second transition area 406, the uncovering area 410, the third transition area 414, the marking area 204, the inspection area 212, the fourth transition area 418, the inversion area 216, the fifth transition area 422, and the unloading area 224 may vary depending on the location of each mounting mandrel. That is, one or more of the arms 252, 256, the engagement members 306, 310, and the anvil 356 may be moved to various different positions in each of the mounting area 200, the first transition area 398, the gripping area 402, the second transition area 406, the uncovering area 410, the third transition area 414, the marking area 204, the inspection area 212, the fourth transition area 418, the inversion area 216, the fifth transition area 422, and the unloading area 224.

With reference to FIG. 12, in the mounting area 200, the mandrel 108 is in a loading configuration. In the loading configuration, the anvil 356 is in the disengaged position, the engagement members 306, 310 are in the retracted position, and the first arm 252 and the second arm 256 are in the disengaged position. The disengaged position of the first arm 252 and the second arm 256 facilitates loading of the glove 370 onto the mandrel 108 by placing the glove 370 on the first and second arm 256 (i.e., the first and second arms 252, 256 are insertable into the hand receiving aperture 382 of the glove 370).

Figure 13:
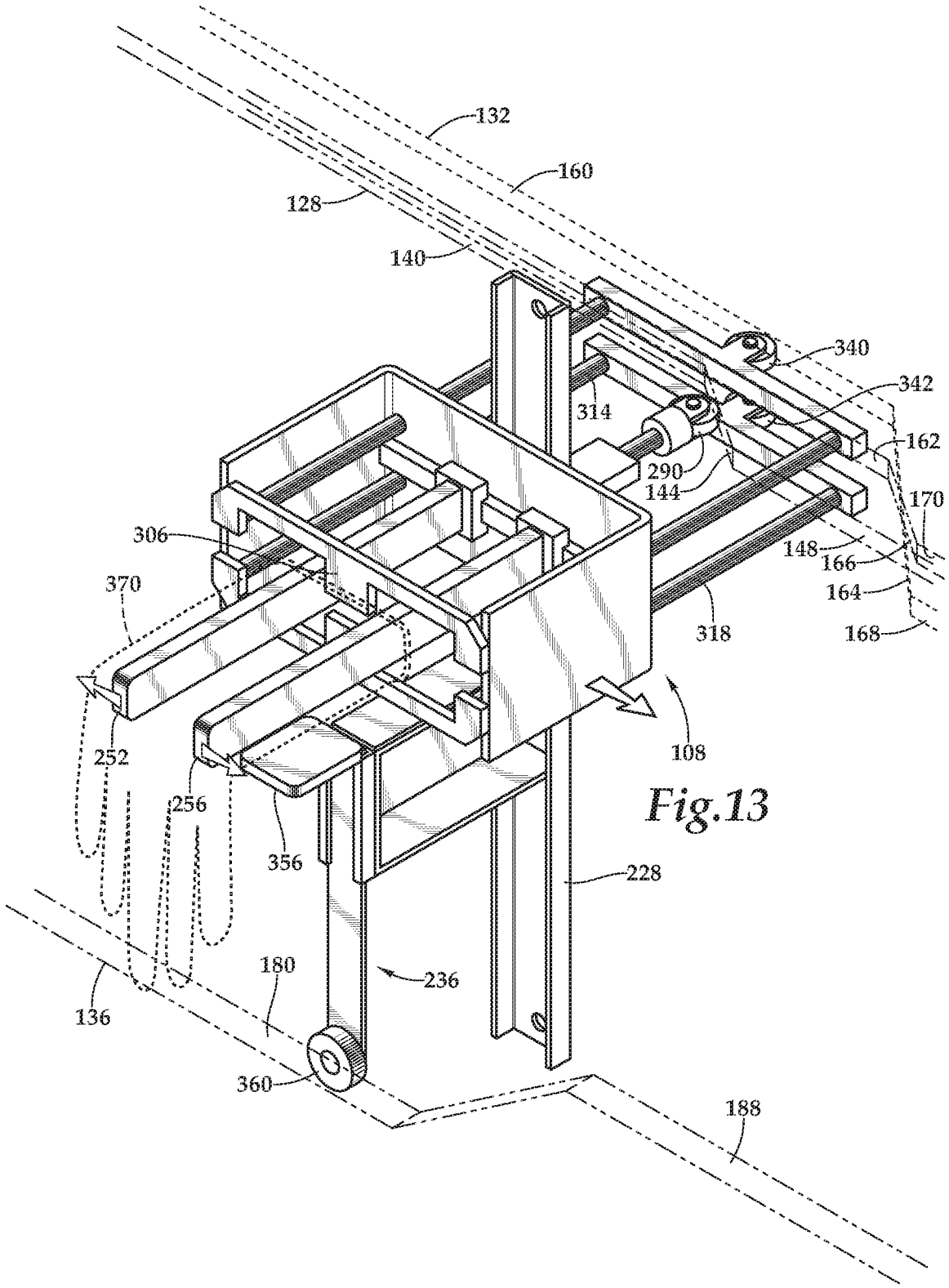
FIG. 13 is a perspective view illustration of the elastomeric article processing system with the mounting mandrel in a first transition area.

With reference to FIG. 13, in the first transition area 398, the mandrel 108 is in a first transition configuration. In the first transition configuration, the anvil 356 is in the disengaged position, the engagement members 306, 310 are in the retracted position, and the first arm 252 and the second arm 256 are transitioning from the disengaged position to the engaged position via engagement between the roller bearing 390 and the first sloped portion 144 of the arm actuating cam surface 128.

Figure 14:
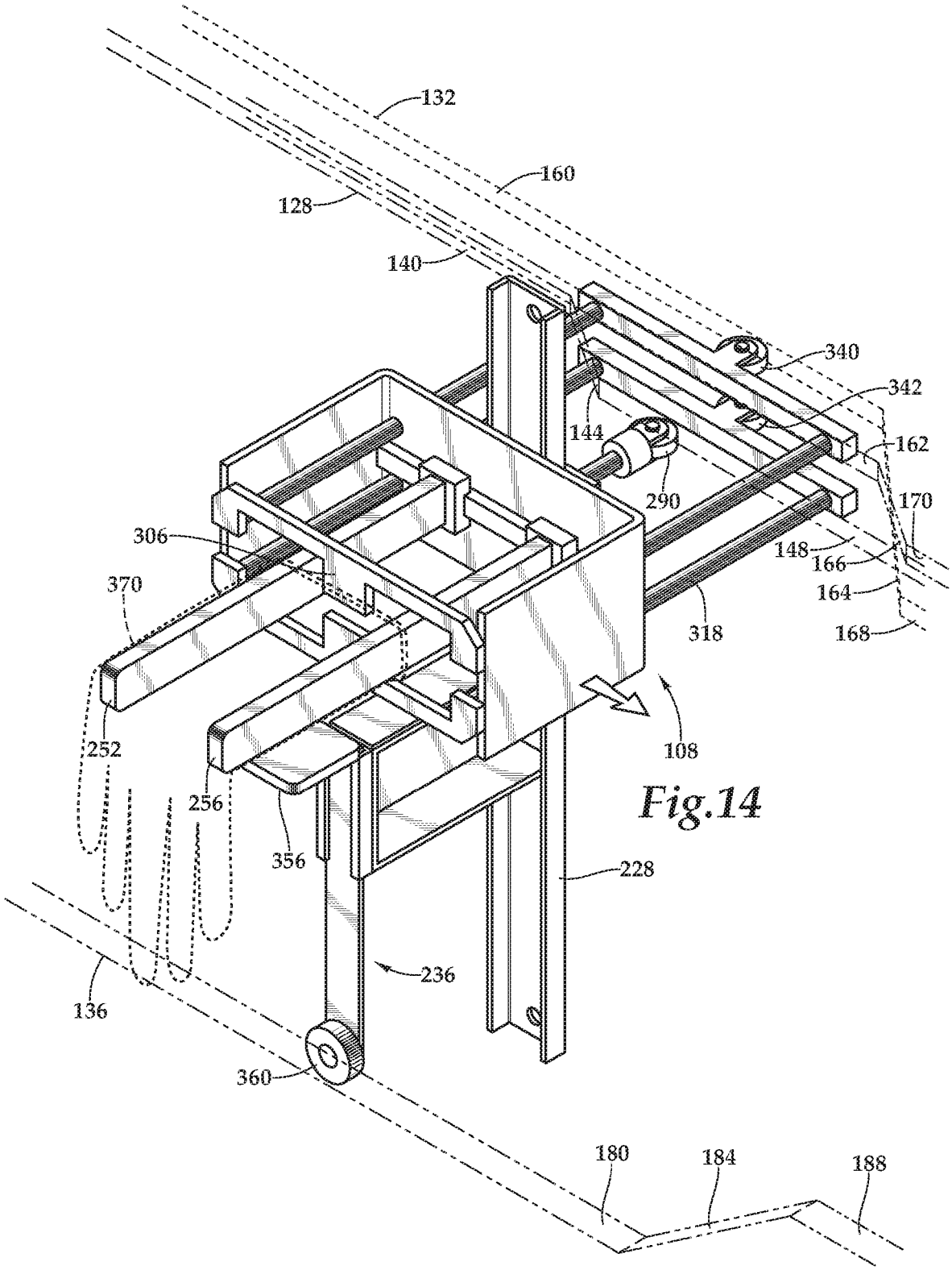
FIG. 14 is a perspective view illustration of the elastomeric article processing system with the mounting mandrel in a gripping area.

With reference to FIG. 14, in the gripping area 402, the mandrel 108 is in a gripping configuration. In the gripping configuration, the anvil 356 is in the disengaged position, the engagement members 306, 310 are in the retracted position, and the first arm 252 and the second arm 256 are in the engaged position. The engaged position of the first arm 252 and the second arm 256 facilitates retention of the glove 370 on the mandrel 108 by expanding the first and second arms 252, 256 apart from each other to grip the glove 370.

Figure 15:
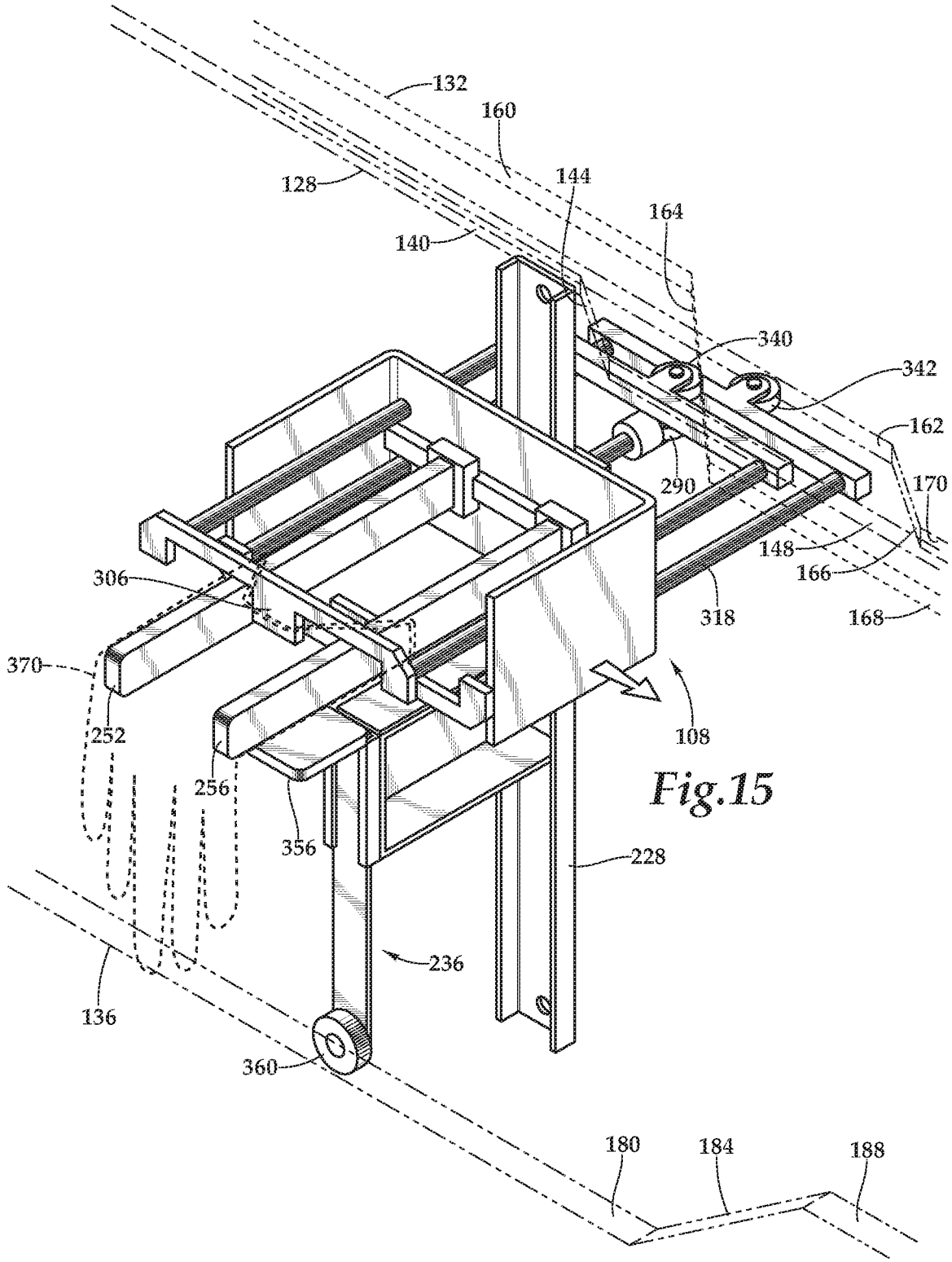
FIG. 15 is a perspective view illustration of the elastomeric article processing system with the mounting mandrel in a second transition area.

With reference to FIG. 15, in the second transition area 406, the mandrel 108 is in a second transition configuration. In the second transition configuration, the anvil 356 is in the disengaged position, the engagement member 306 is transitioning from the retracted position to the extended position via engagement between the roller bearing 340 and the first sloped portion 164 of the first engagement member actuating cam surface 132, the second engagement member 310 is in the retracted position, and the first arm 252 and the second arm 256 are in the engaged position. The movement of the first engagement member 306 from the retracted position to the extended position brings the first engagement element 322 into contact with the wrist portion 386 of the glove 370 to begin moving (e.g., drawing or pushing) a first (e.g., upper) section of the wrist portion 386 toward the palm and finger portions, thereby beginning to expose the printing area 400.

Figure 16:
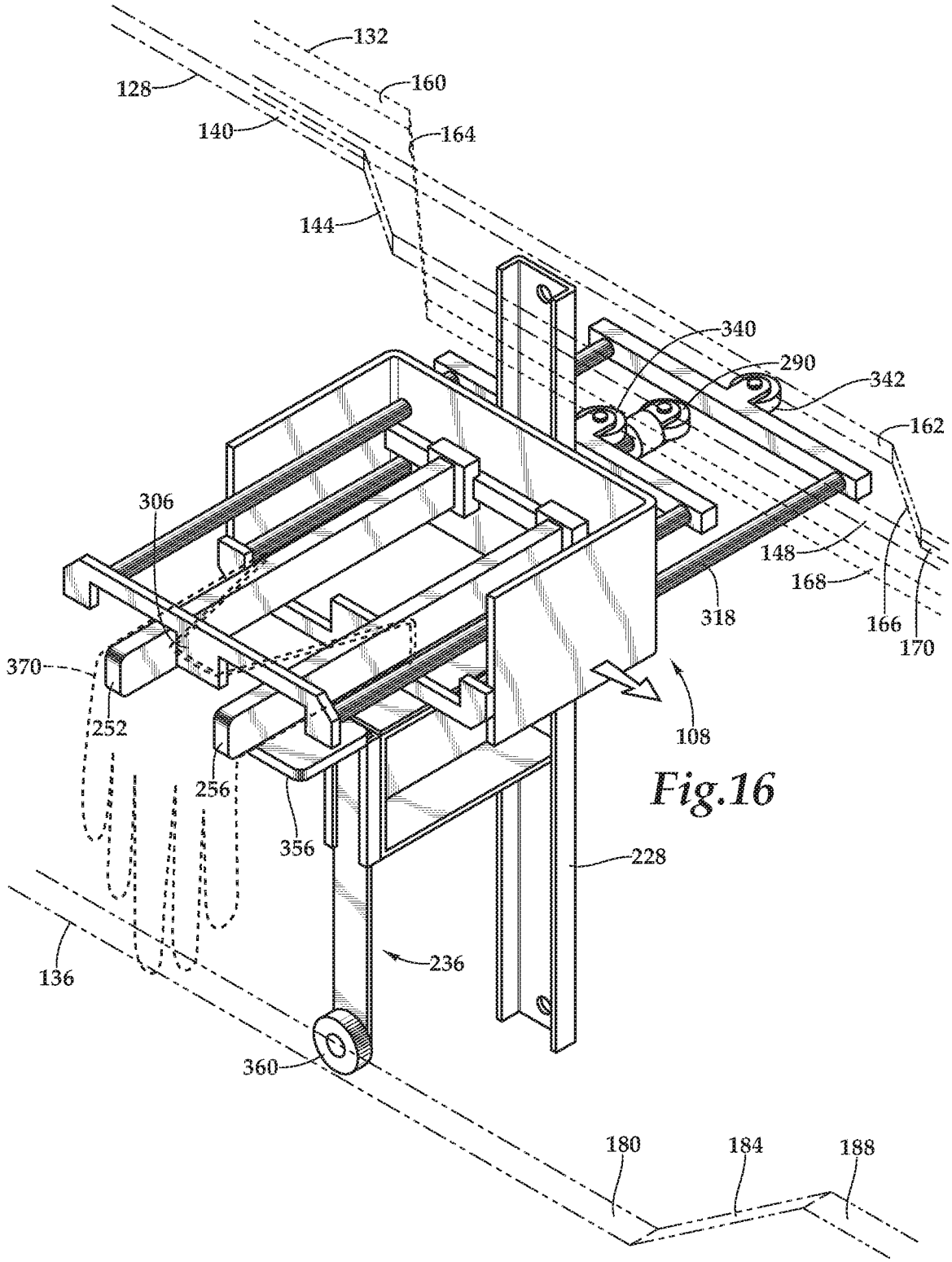
FIG. 16 is a perspective view illustration of the elastomeric article processing system with the mounting mandrel in an uncovering area.

With reference to FIG. 16, in the uncovering area 410, the mandrel 108 is in an uncovering configuration. In the uncovering configuration, the anvil 356 is in the disengaged position, the first engagement member 306 is in the extended position, the second engagement member 310 is in the retracted position, and the first arm 252 and the second arm 256 are in the engaged position. The extended position of the first engagement member 306 exposes the printing area 400 by holding a section of the wrist portion 386 in a position that is displaced toward the palm and finger portions.

Figure 17:
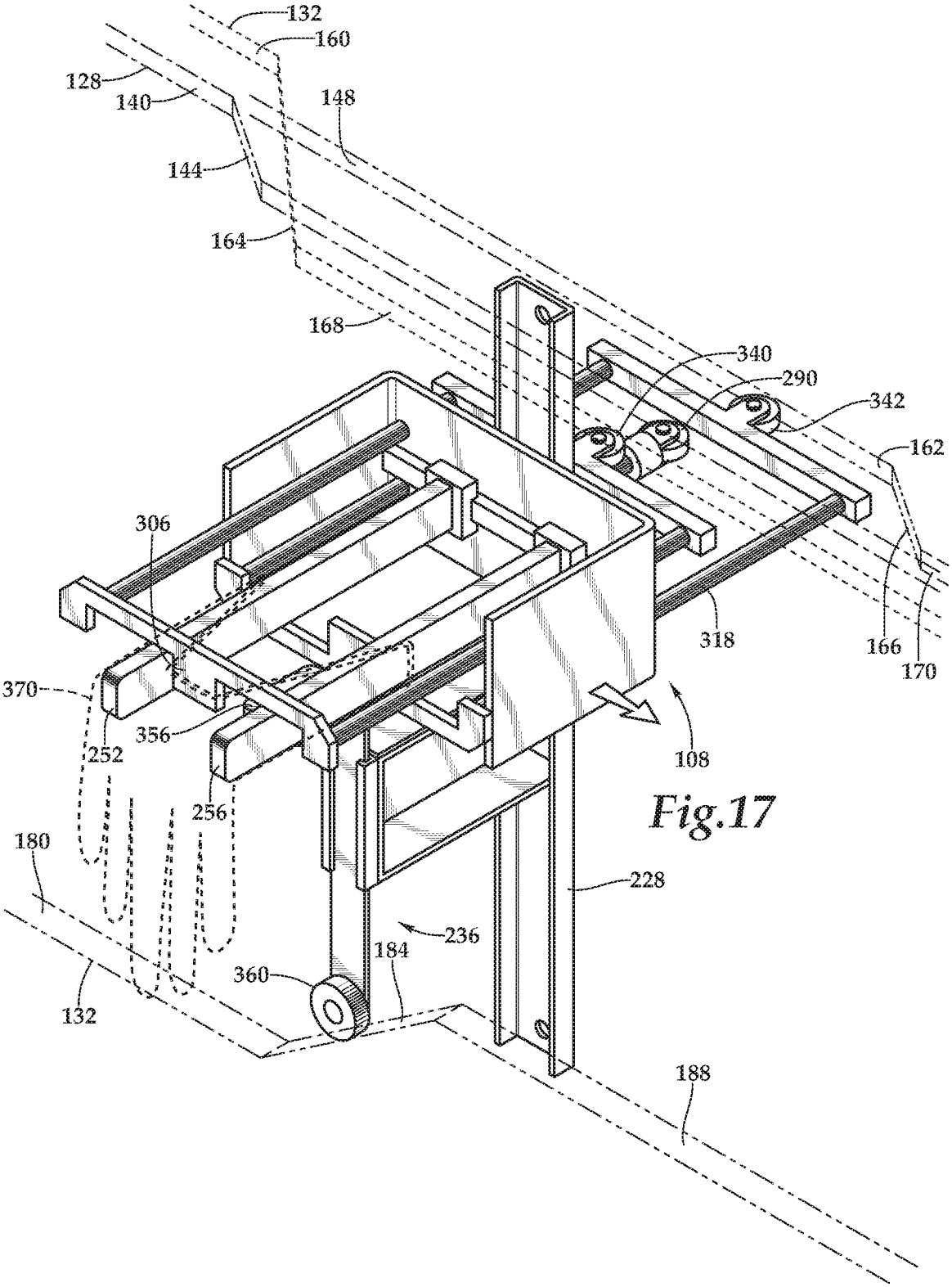
FIG. 17 is a perspective view illustration of the elastomeric article processing system with the mounting mandrel in a third transition area.

With reference to FIG. 17, in the third transition area 414, the mandrel 108 is in a third transition configuration. In the third transition configuration, the anvil 356 is transitioning from the disengaged position to the engaged position via engagement between the roller bearing 360 and the first sloped portion 184 of the anvil actuating cam surface 136, the first engagement member 306 is in the extended position, the second engagement member 310 is in the retracted position, and the first arm 252 and the second arm 256 are in the engaged position. The movement of the anvil 356 from the disengaged position to the engaged position brings the anvil 356 into contact with a section of the glove 370 that is on an outer side (e.g., the interior side 374 of the glove 370 if the glove 370 is inverted) that is opposite the printing area 400.

With reference to FIG. 18, in the marking area 204, the mandrel 108 is in a marking configuration. In the marking configuration, the anvil 356 is in the engaged position, the first engagement member 306 is in the extended position, the second engagement member 310 is in the retracted position, and the first arm 252 and the second arm 256 are in the engaged position. The engaged position of the anvil 356 allows the planar or smooth surface of the anvil 356 to support the printing area 400 to ensure a quality, flat printing area 400 that the printer 208 can mark. The printer 208, or a portion of the printer 208, may be configured to move in coordination with the glove during printing, or the printer 208 may be configured to be stationary and print as the glove passes. In either case, one or more sensors and controllers may adjust the translation and/or printing speed to coordinate with the speed of the glove 370 during printing.

With reference to FIG. 19, in the inspection area 212, the mandrel 108 is in an inspection configuration. In the inspection configuration, the anvil 356 is in the engaged position, the first engagement member 306 is in the extended position, the second engagement member 310 is in the retracted position, and the first arm 252 and the second arm 256 are in the engaged position. The engaged position of the anvil 356 also allows for visual or automated inspection of the printed markings to ensure the quality of the marking.

Figure 20:
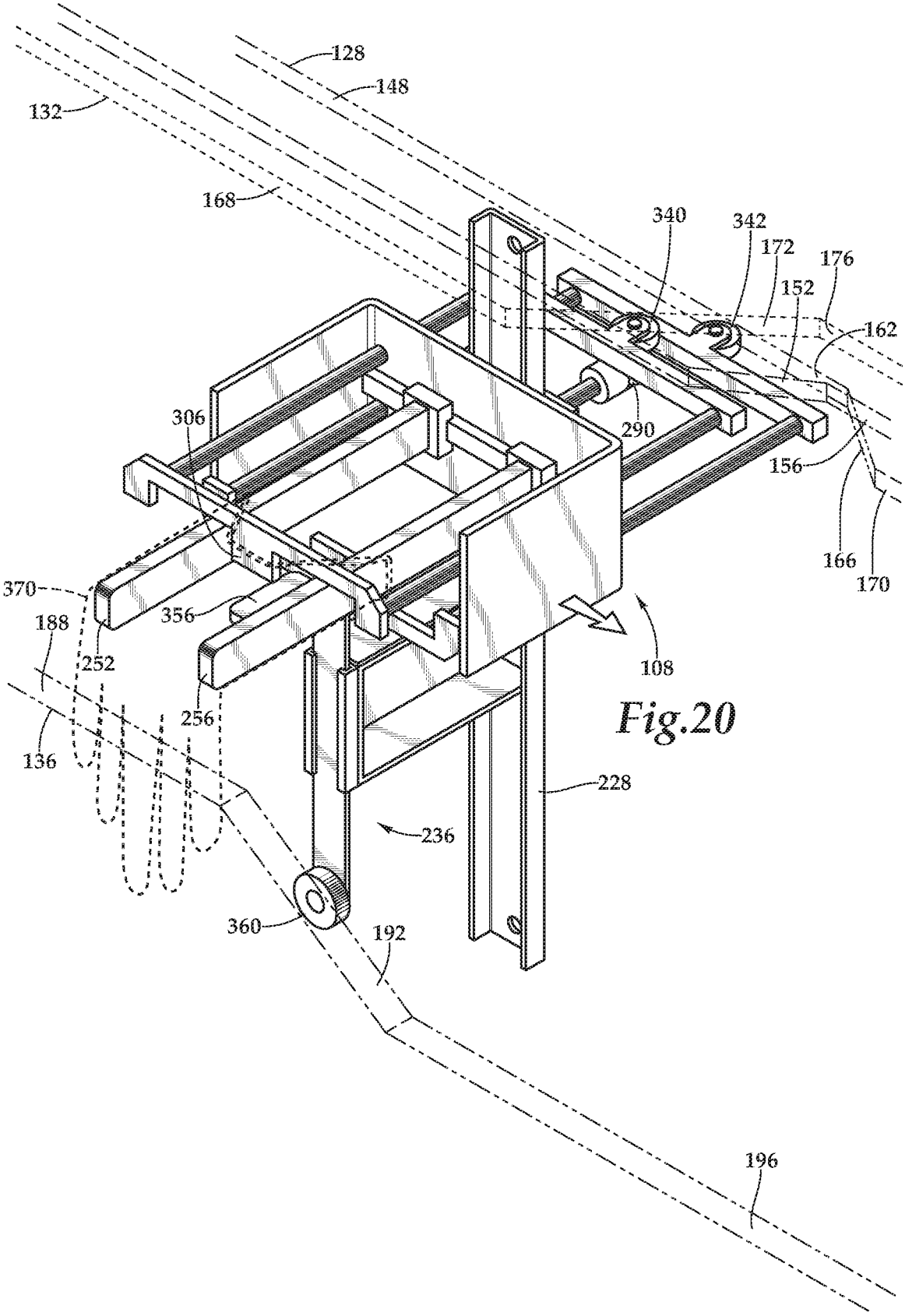
FIG. 20 is a perspective view illustration of the elastomeric article processing system with the mounting mandrel in a fourth transition area.

With reference to FIG. 20, in the fourth transition area 418, the mandrel 108 is in a fourth transition configuration.

In the fourth transition configuration, the anvil 356 is transitioning from the engaged position to the disengaged position via engagement between the roller bearing 360 and the second sloped portion 192 of the anvil actuating cam surface 136, the first engagement member 306 is transitioning from the extended position to the retracted position via engagement between the roller bearing 340 and the second sloped portion 172 of the first engagement member actuating cam surface 132, the second engagement member 310 is in the retracted position, and the first arm 252 and the second arm 256 are in the engaged position.

With reference to FIG. 21, in the inversion area 216, the mandrel 108 is in an inversion configuration. In the inversion configuration, the anvil 356 is in the disengaged position, the first engagement member 306 is in the retracted position, the second engagement member 310 is in the extended position, and the first arm 252 and the second arm 256 are in the engaged position. The second engagement member 310 is in the extended position after transitioning from the retracted position to the extended position via engagement between the roller bearing 342 and the first linear portion 162 of the second engagement member actuating cam surface 134 in the retracted position, to the first sloped portion 166, and to the second linear portion 170 in the extended position. The engaged position of the first arm 252 and the second arm 256 facilitates retention of the glove 370 on the mandrel 108 as the inversion device 220 drives the glove 370 to invert. In the illustrated embodiment, the glove 370 inversion device 220 includes an air nozzle that directs a jet of air at the glove 370 in order to cause the finger portion 394 and optionally at least a portion of the palm portion 390 to pass through the hand receiving aperture 382, partially inverting the glove 370 while leaving at least a portion of the wrist portion 386 folded over the inverted portions of the glove 390.

Figure 22:
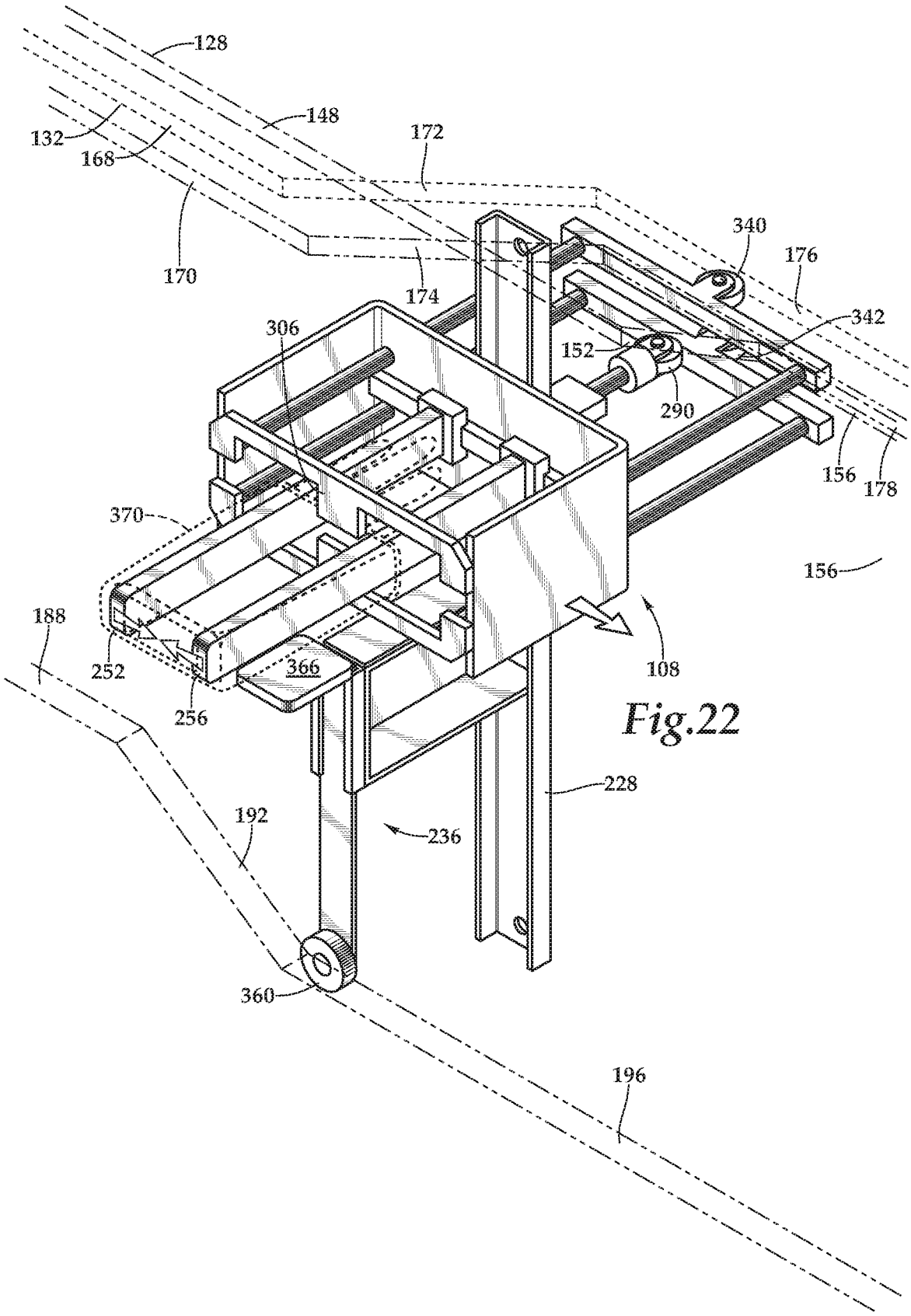
FIG. 22 is a perspective view illustration of the elastomeric article processing system with the mounting mandrel in a fifth transition area.

With reference to FIG. 22, in the fifth transition area 422, the mandrel 108 is in a fifth transition configuration. In the fifth transition configuration, the anvil 356 is in the disengaged position, the first engagement member 306 is in the retracted position, the second engagement member 310 is in the retracted position after transitioning from the extended position to the retracted position via engagement between the roller bearing 342 and the second linear portion 170 of the second engagement member actuating cam surface 134 in the extended position, to the second sloped portion 174, and to the third linear portion 178 in the retracted position, and the first arm 252 and the second arm 256 are transitioning from the engaged position to the disengaged position via engagement between the roller bearing 290 and the second sloped portion 152 of the arm actuating cam surface 128.

With reference to FIG. 23, in the unloading area 224, the mandrel 108 is in an unloading configuration. In the unloading configuration, the anvil 356 is in the disengaged position, the engagement members 306, 310 are in the retracted position, and the first arm 252 and the second arm 256 are in the disengaged position. The disengaged position of the first arm 252 and the second arm 256 facilitates unloading of the glove 370 from the mandrel 108 by moving the arms 252, 256 toward each other to release their grip on the glove 370 so that the glove 370 can be pulled off the mandrel 108.

In operation, the conveyor chains 112, 116 are driven by the prime mover 124 to effect movement of the mandrels 108 that are coupled to the conveyor chains 112, 116 such that the mandrels 108 continuously move around the conveyor body 120. This movement of the mandrels 108 causes the mandrels 108 to systematically advance through the configurations associated with each of the mounting area 200, the first transition area 398, the gripping area 402, the second transition area 406, the uncovering area 410, the third transition area 414, the marking area 204, the inspection area 212, the fourth transition area 418, the inversion area 216, the fifth transition area 422, and the unloading area 224, as described above.

Figure 24:
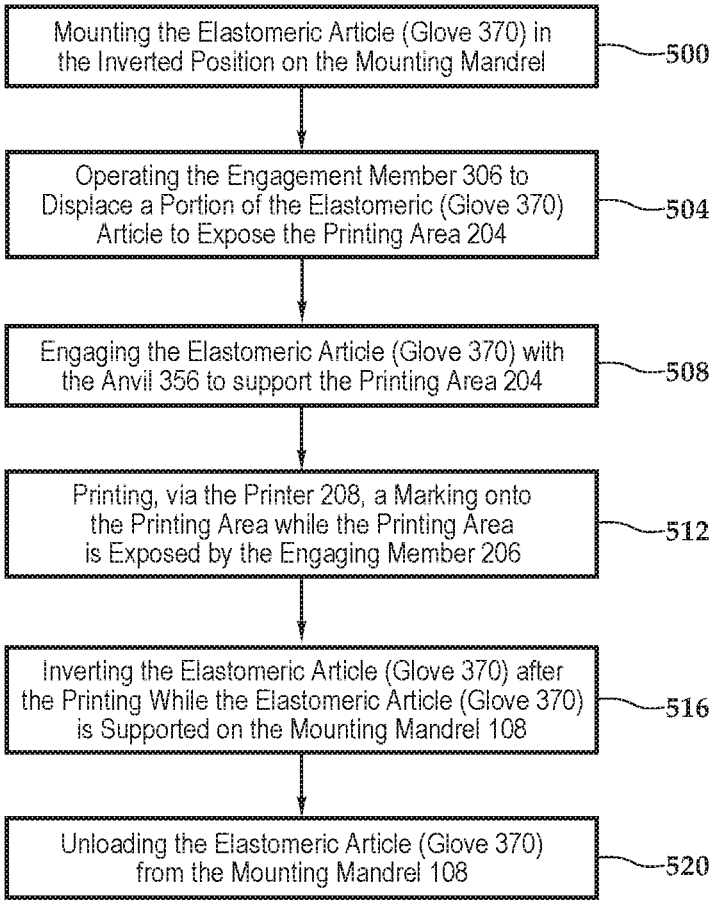
FIG. 24 is a flow chart of a method for manufacturing an elastomeric article using the elastomeric article processing system of FIG. 1.

FIG. 24 depicts a method for manufacturing or processing an elastomeric article (e.g., the glove 370) using the processing system 100 described above. A first step 500 of the method includes mounting (either manually or via an automated device), in the mounting area 200, an inverted glove 370 on to the first arm 252 and the second arm 256 of the mandrel 108 by inserting the first arm 252 and the second arm 256 into the hand receiving aperture 382 such that a predetermined portion of the wrist portion 386 is received by the first arm 252 and the second arm 256. The glove 370 is then gripped by movement of the mandrel 108 from the mounting configuration in the mounting area 200 to the gripping configuration in the gripping area 402 to complete mounting of the glove 370.

A second step 504 of the method may include operating the first engagement member 306 to displace a portion of the glove 370 to expose the printing area 400 by moving the mandrel 108 from the gripping configuration to the uncovered configuration.

A third step 508 of the method may include engaging the glove 370 with the anvil 356 to support the printing area 400 by moving the mandrel 108 from the uncovered configuration to the marking configuration.

A fourth step 512 of the method may include printing, via a printer 208, a marking on to the printing area 400 while the printing area 400 is exposed by the first engagement member 306 while the mandrel 108 is in the marking configuration. The fourth step 512 may also include manual or automated inspection of the printed markings to ensure the quality of the marking.

A fifth step 516 of the method may include inverting and/or cuffing the glove 370 after the printing, while the glove 370 is supported on the mounting mandrel 108. The inversion may be accomplished by the inversion device 220 after the mandrel 108 has been moved from the marking configuration to the inversion configuration. The fifth step may include enlarging the hand receiving aperture 382 before or during inversion, for example, by causing the second engagement member 310 to engage and displace a portion of the glove 370 to stretch the hand receiving aperture 382. Enlarging the hand receiving aperture 382 facilitates passage of the finger and/or palm portions through the hand receiving aperture 382 during inversion, and allows the inverted portions of the glove to inflate more completely, facilitating more consistent positioning of the inverted portions of the glove. The inversion of the glove 370 from the inverted position to the standard position causes the predetermined portion of the wrist portion 386 that was gripped by the first arm 252 and the second arm 256 to form a cuff on the glove 370.

Finally, the method may include a sixth step 520 including unloading (either manually or via an automated device) the glove 370 from the mandrel 108 after the mandrel 108 has moved from the inversion configuration to the unloading configuration. Since the conveyor device 104 described herein is a continuous loop conveyor, and due to the fact that the mounting configuration and the unloading configuration of the mandrel 108 are the same, the mandrel 108 may be advanced from the unloading area 224 to the mounting area 200 without requiring a change in configuration.

In various embodiments, one or more mandrels 108 are fixedly coupled to the conveyor body 120. In this embodiment, the prime mover 124 is coupled to each of the arm actuating cam surface 128, the engagement member actuating cam surfaces 132, 134, and the anvil actuating cam surface 136 via, for example, a transmission, to drive movement of the arm actuating cam surface 128, the engagement member actuating cam surface 132, and the anvil actuating cam surface 136 relative to the mandrels 108 As such, the arms 252, 256, the engagement members 306, 310, and the anvil 356 will be cycled through the positions corresponding to the mounting area 200, the first transition area 398, the gripping area 402, the second transition area 406, the uncovering area 410, the third transition area 414, the marking area 204, the inspection area 212, the fourth transition area 418, the inversion area 216, the fifth transition area 422, and the unloading area 224 in the same manner and order described above, but the mandrels 108 will remain stationary while the cam surfaces 128, 132, 134, 136 are driven to move.

In various embodiments, the arms 252, 256, the engagement members 306, 310, and the anvil 356 are coupled to one or more actuators (e.g., linear actuators, solenoids) instead of the roller bearings 290, 340, 342, 360. The actuators are operated (e.g., via power inputted from the prime mover 214) to cycle the arms 252, 256, the engagement members 306, 310, and the anvil 356 through the positions corresponding to the mounting area 200, the first transition area 398, the gripping area 402, the second transition area 406, the uncovering area 410, the third transition area 414, the marking area 204, the inspection area 212, the fourth transition area 418, the inversion area 216, the fifth transition area 422, and the unloading area 224 in the same order described above. In this configuration, the mandrels 108 may be coupled to the conveyor chains 112, 116 such that the mandrels 108 are driven by the prime mover 124 to move relative to the conveyor body 120. Alternatively, the mandrels 108 may be fixedly coupled to the conveyor body 120.

In various embodiments, the anvil 356 and the anvil actuating cam surface 136 may be omitted and the printer 208 may print on the glove 370 without the support of the anvil 356. In other embodiments, the marking may be made on the interior side 374 of the glove 370 while the glove is mounted on the mounting mandrel in an inverted state (i.e., the interior side 374 is facing outward) such that the marking is visible through a glove that is at least partially transparent. The marking may be made in reverse such that the marking appears to be properly oriented when viewed through the glove from the exterior side 378. In these embodiments, the first engagement member 306 and the first engagement member actuating cam surface may be omitted since the print area of a glove mounted in the mounting mandrel would be exposed without the need to displace a portion of the glove to expose the print area.

The elastomeric article processing system 100 described above has several advantages over the prior art. Since the glove 370 may be mounted on the mandrel 108 in the inverted position, and printing can occur in the inverted position onto the printing area 400 disposed on the exterior side 378 of the glove 370, and because inversion creates a cuff, the elastomeric article processing system 100 improves processing efficiency. That is, instead of employing the conventional procedure of inverting the glove 370 to the standard position, printing the marking onto the printing area 400, and then cuffing the glove 370, the elastomeric article processing system 100 prints while the glove 370 is inverted to allow inversion and cuffing to occur in a single step. This is accomplished by, among other things, the design of the mandrels 108. Furthermore, the entire secondary processing of the glove 370 can be carried out while the glove 370 is on the same mandrel 108, rather than having to manually move or manipulate the glove 370.

Although the invention has been described in detail with reference to certain preferred embodiments, variations and modifications exist within the scope and spirit of one or more independent aspects of the invention. Various features of the invention are set forth in the following claims.

What is claimed is:

1. A system for processing an elastomeric article, wherein the elastomeric article is a glove having a finger portion, a palm portion, a hand-receiving aperture, a first surface, and a second surface, wherein the elastomeric article has a first configuration wherein at least a portion of the first surface defines a first interior space and at least a portion of the second surface faces outward from the first interior space, and a second configuration wherein at least a portion of the second surface defines a second interior space and at least a portion of the first surface faces outward from the second interior space, and wherein the elastomeric article processing system comprises:

a conveyor chain;

a mounting mandrel coupled to the conveyor chain, the mounting mandrel including an arm configured to support the elastomeric article in the first configuration and in the second configuration; and an inversion device configured to displace the finger portion and optionally the palm portion through the hand-receiving aperture in order to invert at least a portion of the elastomeric article from the first configuration to the second configuration while the article is supported by the arm.

2. The system of claim 1, wherein the arm is configured to engage the first surface of the elastomeric article to support the article when the article is in the first configuration.

3. The system of claim 2, wherein the arm is configured to engage the first surface of the elastomeric article when the article is in the first configuration and in the second configuration.

4. The system of claim 1, wherein the arm of the mounting mandrel is a first arm and the mounting mandrel includes a second arm, the first arm and the second arm having a disengaged position for receiving the elastomeric article and an engaged position for engaging the elastomeric article.

5. The system of claim 4, wherein the first arm and the second arm are separated by a first length in the disengaged position and a second length in the engaged position, wherein the second length is greater than the first length.

6. The system of claim 5, wherein the first arm and the second arm are configured to enlarge the hand-receiving aperture of the elastomeric article in the engaged position.

7. The system of claim 1, further comprising a movable engagement member configured to engage a portion of the elastomeric article to enlarge the hand-receiving aperture of the article when the inversion device inverts at least a portion of the elastomeric article from the first configuration to the second configuration.

8. The system of claim 1, wherein the inversion device includes an air jet that directs pressurized air towards the elastomeric article.

9. The system of claim 1, wherein the first arm and the second arm engage a wrist portion of the glove.

10. A method for processing an elastomeric article, wherein the elastomeric article is a glove comprising a finger portion, a palm portion, and a hand-receiving aperture, and wherein the method comprises:

mounting the elastomeric article in a first configuration on a mounting mandrel;

engaging a portion of the elastomeric article with an arm of the mounting mandrel;

displacing the finger portion and optionally the palm portion through the hand-receiving aperture in order to at least partially invert the elastomeric article to a second configuration while the arm is engaged with the elastomeric article; and disengaging the arm from the elastomeric article after at least partially inverting the elastomeric article.

11. The method of claim 10, further comprising operating a movable engagement member to enlarge the hand-receiving aperture of the elastomeric article such that the hand-receiving aperture is enlarged while the at least a portion of the elastomeric article passes through the hand-receiving aperture.

12. The method of claim 11, wherein operating the movable engagement member includes linearly displacing the movable engagement member along a direction parallel to an axis defined by the arm to displace a portion of the elastomeric article away from the mandrel.

13. The method of claim 10, wherein the elastomeric article includes a first surface and a second surface, wherein the second surface faces outward when the elastomeric article is in the first configuration and the first surface faces outward when the elastomeric article is in the second configuration.

14. The method of claim 10, wherein inverting at least a portion of the elastomeric article includes applying pressurized air from an air jet to the elastomeric article.

15. The method of claim 10, wherein inverting the elastomeric article includes creating a cuff on the glove.

* * * * *